US011181258B2

(12) United States Patent
Worman

(10) Patent No.: US 11,181,258 B2
(45) Date of Patent: Nov. 23, 2021

(54) TAIL SWITCH ARRANGEMENT FOR A LIGHT

(71) Applicant: STREAMLIGHT, INC., Eagleville, PA (US)

(72) Inventor: William D. Worman, Phoenixville, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 17/125,537

(22) Filed: Dec. 17, 2020

(65) Prior Publication Data

US 2021/0190304 A1 Jun. 24, 2021

Related U.S. Application Data

(63) Continuation of application No. 16/725,670, filed on Dec. 23, 2019, now Pat. No. 10,928,051.

(51) Int. Cl.

| | |
|---|---|
| ***F21V 23/04*** | (2006.01) |
| ***F41G 11/00*** | (2006.01) |
| ***F21L 4/00*** | (2006.01) |
| ***F21V 21/088*** | (2006.01) |
| ***F21V 23/06*** | (2006.01) |
| ***F21V 23/00*** | (2015.01) |

(52) U.S. Cl.

CPC ..... *F21V 23/0421* (2013.01); *F21L 4/005* (2013.01); *F21V 21/0885* (2013.01); *F21V 23/006* (2013.01); *F21V 23/0435* (2013.01); *F21V 23/06* (2013.01); *F41G 11/004* (2013.01)

(58) Field of Classification Search

CPC .... F21V 23/0421; F21V 23/006; F21V 23/06; F21V 23/0435; F21V 21/0885; F21L 4/005; F41G 11/004

See application file for complete search history.

(56) References Cited

U.S. PATENT DOCUMENTS

| | | | | |
|---|---|---|---|---|
| 3,737,655 | A | 6/1973 | Blendinger et al. | |
| 5,629,105 | A * | 5/1997 | Matthews | F21L 2/00 429/97 |
| 5,818,148 | A | 10/1998 | Shiomi | |
| 7,186,002 | B2 | 3/2007 | Matthews et al. | |
| D567,894 | S | 4/2008 | Sterling et al. | |
| 8,096,674 | B2 | 1/2012 | Matthews et al. | |
| D674,858 | S | 1/2013 | Galli | |
| 8,425,078 | B2 | 4/2013 | Matthews et al. | |
| 8,944,626 | B2 | 2/2015 | Matthews et al. | |

(Continued)

OTHER PUBLICATIONS

International Searching Authority, "PCT—International Search Report & Written Opinion", PCT/US20/66597, dated Mar. 15, 2021, 21 pages.

*Primary Examiner* — Evan P Dzierzynski

(74) *Attorney, Agent, or Firm* — Clement A. Berard, Esq.; Dann, Dorfman, Herrell & Skillman, PC

(57) ABSTRACT

A switch for a light may comprise: an electrical switch actuatable in a direction transverse to the electrical switch; a switch actuator including: a plunger adjacent the electrical switch movable pivotably for actuating and de-actuating the electrical switch. A flexible boot may move the plunger toward the electrical switch when the flexible boot is pressed. The electrical switch is actuated when the flexible boot is pressed toward the electrical switch or at an angle therebetween. The switch may be adjacent a reference plane surface in a light body of the light.

27 Claims, 13 Drawing Sheets

(56) References Cited

U.S. PATENT DOCUMENTS

| | | | | |
|---|---|---|---|---|
| 8,960,942 | B2 | 2/2015 | Galli et al. | |
| D788,965 | S | 6/2017 | Roshak et al. | |
| 9,874,337 | B2 | 1/2018 | Gallie et al. | |
| D813,340 | S | 3/2018 | Galli | |
| 9,958,143 | B2 | 5/2018 | Gallie et al. | |
| D829,841 | S | 10/2018 | Galli | |
| 1,036,506 | A1 | 7/2019 | Tayon et al. | |
| 1,092,805 | A1 | 2/2021 | Worman | |
| 10,928,051 | B1 | 2/2021 | Worman | |
| 2013/0220063 | A1* | 8/2013 | Mori | G05G 1/04 74/523 |
| 2015/0001056 | A1* | 1/2015 | Colonna | H01H 21/08 200/335 |
| 2015/0316355 | A1 | 11/2015 | Boswell | |
| 2016/0018071 | A1* | 1/2016 | Sharrah | F21V 21/0885 362/184 |
| 2017/0284646 | A1 | 10/2017 | Arena et al. | |
| 2019/0154243 | A1 | 5/2019 | Worman | |

* cited by examiner

10'
20'
50
14
30
60
62
40
12

10'
50
34
20'
40
12
60
64
62
30
38
23B
38R
14

TAIL SWITCH ARRANGEMENT FOR A LIGHT

This application is a continuation of U.S. patent application Ser. No. 16/725,670 entitled "TAIL SWITCH ARRANGEMENT FOR A LIGHT" filed on Dec. 23, 2019, which is hereby incorporated herein by reference.

The present invention relates to a light and, in particular, to a light and a switch arrangement therefor.

Most portable lights have an actuator, e.g., of an electrical switch, that is configured to be actuated in a relatively specific direction relative to the light and its body. For example, lights having a switch actuator at the tail end thereof are generally configured to have that switch actuated in a forward direction generally along the longitudinal axis thereof. In another example, lights having a switch actuator on a side thereof are generally configured to have that switch actuated in a direction transverse tot eh longitudinal axis thereof.

Lights intended to be mounted to a firearm generally have one or more switch actuators that are configured to be actuated in a particular direction. Some lights intended for handguns, for example, have switch actuators on the rear end thereof that are actuated by their being moved upward and/or downward, e.g., rotating upwardly and/or downwardly about a longitudinal axis of the light. Other lights intended for handguns have actuators that are actuated by their being pressed inwardly, e.g., transversely to the longitudinal axis thereof, so as to be moved closer to the longitudinal axis thereof.

Lights intended to be mounted to a long gun (long arm) are typically mounted along the barrel, typically towards the muzzle, and have a switch actuator thereon and/or may have an external switch, e.g., on a cable, which can be placed relatively closer to the trigger thereof than is the light. However, such lights may also be actuated by a user's non-trigger hand which is typically used to grip and/or support the forward end of the barrel thereof. If such light has a switch actuator on the body thereof, a user may desire to actuate the light by pressing the actuator generally transversely, e.g., in a direction toward the barrel, or forwardly, e.g., longitudinally in a direction toward the muzzle thereof, and at any angle therebetween. Conventional lights typically tend to better accommodate transverse actuation or longitudinal actuation, but not both.

When an external switch actuator at the remote end of an electrical cable is employed, the connector thereof is typically plugged into a receptacle located on the rear surface of the light where the receptacle is exposed to being physically dislodged and/or damaged, and/or the light may be damaged, which is not desirable and may render the remote switch unreliable.

Applicant believes there may be a need for a need for a light that may be effectively actuated by pressing the actuator in a direction either generally transversely, e.g., in a direction toward the barrel, or forwardly, e.g., longitudinally in a direction toward the muzzle thereof, as well as at any angle therebetween.

Accordingly, a switch and light may comprise: a light body defining a longitudinal axis and having an internal cavity for a source of electrical power; a light source on the light body; an electrical switch internal to the light body adjacent to a surface that is substantially parallel to the longitudinal axis, a switch actuator may include a flexible boot disposed at an acute angle relative to the longitudinal axis may further include: a plunger adjacent to the electrical switch and movable in a direction substantially perpendicular to the longitudinal axis for actuating and de-actuating the electrical switch; and an actuator member adjacent to the flexible boot between the flexible boot and the plunger and being movable toward the plunger to move the plunger toward the electrical switch when the flexible boot is pressed, wherein the electrical switch is actuated when the flexible boot is pressed toward the longitudinal axis or substantially parallel to the longitudinal axis or at an angle therebetween.

A switch for a light may comprise: an electrical switch on a reference plane and actuatable in a direction substantially perpendicular to the reference plane; a switch actuator including a flexible boot disposed at an acute angle relative to the reference plane including: a plunger adjacent the electrical switch movable substantially perpendicular to the reference plane for actuating and de-actuating the electrical switch; and an actuator member between the flexible boot and the plunger movable to move the plunger toward the electrical switch when the flexible boot is pressed. The electrical switch is actuated when the flexible boot is pressed toward the reference plane or parallel to the reference plane or at an angle therebetween. The switch may be adjacent a reference plane surface in a light body of the light.

Further, a switch and light may comprise: a light body having an internal cavity for receiving a source of electrical power; a light source disposed in the light body that produces light when energized; an electrical switch internal to the light body, wherein the electrical switch is actuatable by being moved in a direction, wherein the electrical switch may comprise: a switch housing having one or more coaxial pivot recesses; a plunger supported by the switch housing, the plunger having one or more pivot axles respectively disposed in the one or more coaxial pivot recesses of the switch housing, whereby the movement of the plunger includes pivoting on the pivot axles in the opening of the switch housing for actuating and de-actuating the electrical switch; and a flexible boot disposed to cause the plunger to pivot relative to the switch housing and to move toward the electrical switch to actuate the electrical switch; whereby the electrical switch is actuated when the flexible boot is pressed.

Further yet, a switch for a light may comprise: a switch housing having one or more coaxial pivot recesses; a circuit board disposed adjacent an opening of the switch housing and having an electrical switch thereon, wherein the electrical switch is actuatable by being pressed toward the circuit board; a plunger having one or more pivot axles respectively disposed in the one or more coaxial pivot recesses of the switch housing, whereby the movement of the plunger includes pivoting on the pivot axles for actuating and de-actuating the electrical switch; and a flexible boot wherein pressing the flexible boot causes the plunger to pivot and to move toward the circuit board to actuate the electrical switch; whereby the electrical switch is actuated when the flexible boot is pressed toward the circuit board.

A switch and light may comprise: a light body having an internal cavity for receiving a source of electrical power; a light source that produces light when energized; an electrical switch actuatable by being moved transversely to an internal surface, wherein the electrical switch may comprise: a switch housing having an opening therethrough and having one or more coaxial pivot recesses; a plunger having one or more coaxial pivot axles respectively disposed in the one or more coaxial pivot recesses of the switch housing, whereby the movement of the plunger includes pivoting on the pivot axles in the opening of the switch housing for moving the second side thereof toward and away from the internal surface for actuating and de-actuating the electrical switch; and a flexible boot disposed adjacent to the first side of the plunger wherein pressing the flexible boot causes the plunger to pivot relative to the switch housing and the second side of the plunger to move toward the electrical switch to actuate the electrical switch; whereby the electrical switch is actuated when the flexible boot is pressed.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figure 1:
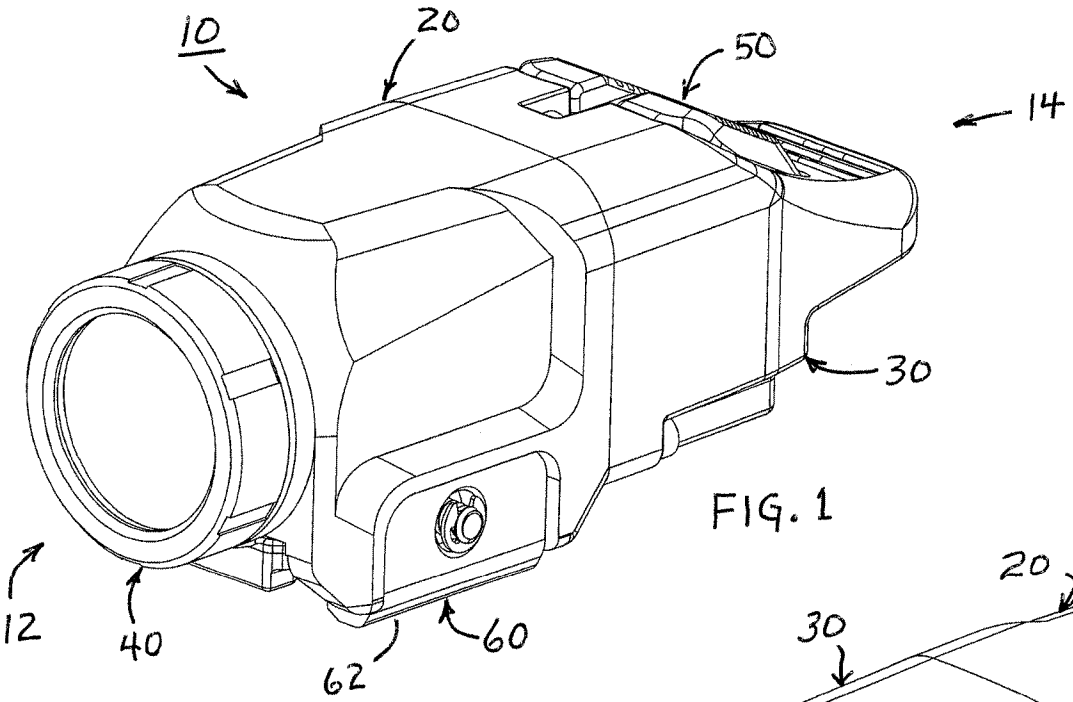
FIGS. 1 and 2 are perspective views of an example embodiment of a light having a switch actuator on the body thereof and, optionally, a plug for being inserted into a connector for an external switch actuator.

In the Drawing, where an element or feature is shown in more than one drawing figure, the same alphanumeric designation may be used to designate such element or feature in each figure, and where a closely related or modified element is shown in a figure, the same alphanumerical designation may be primed or designated "a" or "b" or the like to designate the modified element or feature. Similar elements or features may be designated by like alphanumeric designations in different figures of the Drawing and with similar nomenclature in the specification. As is common, the various features of the drawing are not to scale, the dimensions of the various features may be arbitrarily expanded or reduced for clarity, and any value stated in any Figure is by way of example only.

DESCRIPTION OF THE PREFERRED EMBODIMENT(S)

Figure 2:
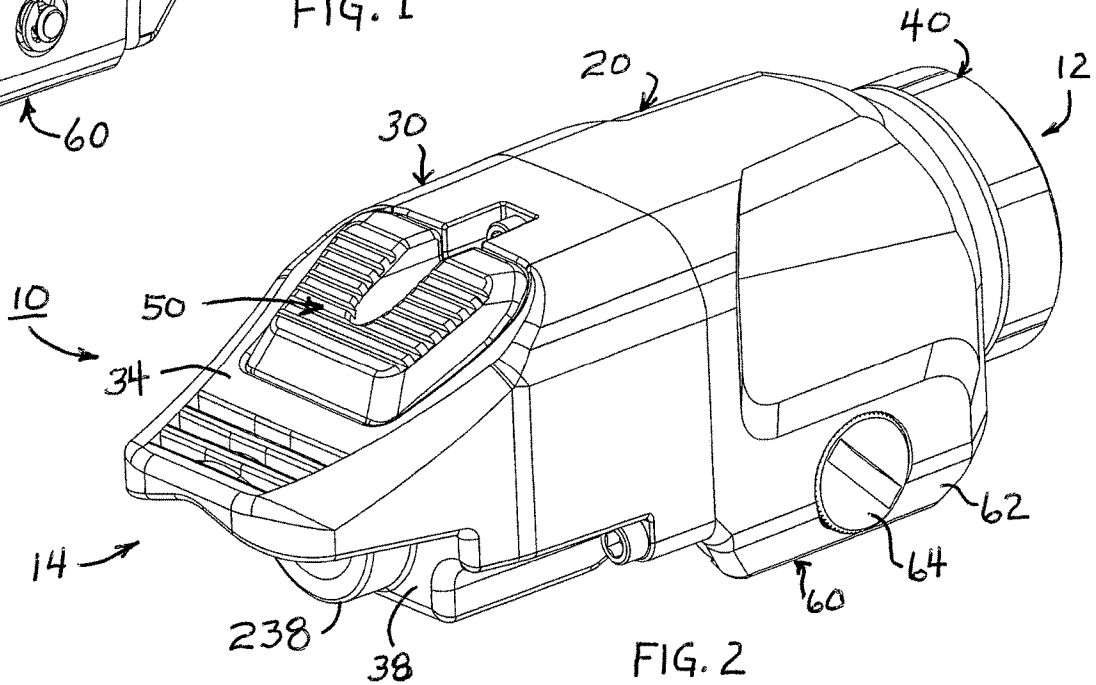
Figure 2A:
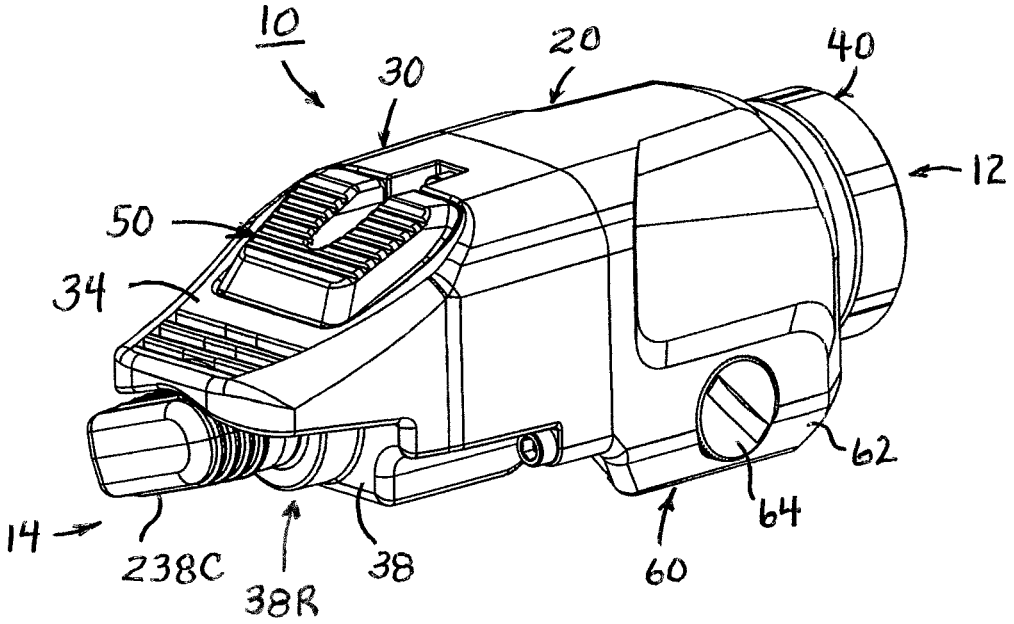
FIG. 2A is a perspective view of the example light including the connector.
Figure 3:
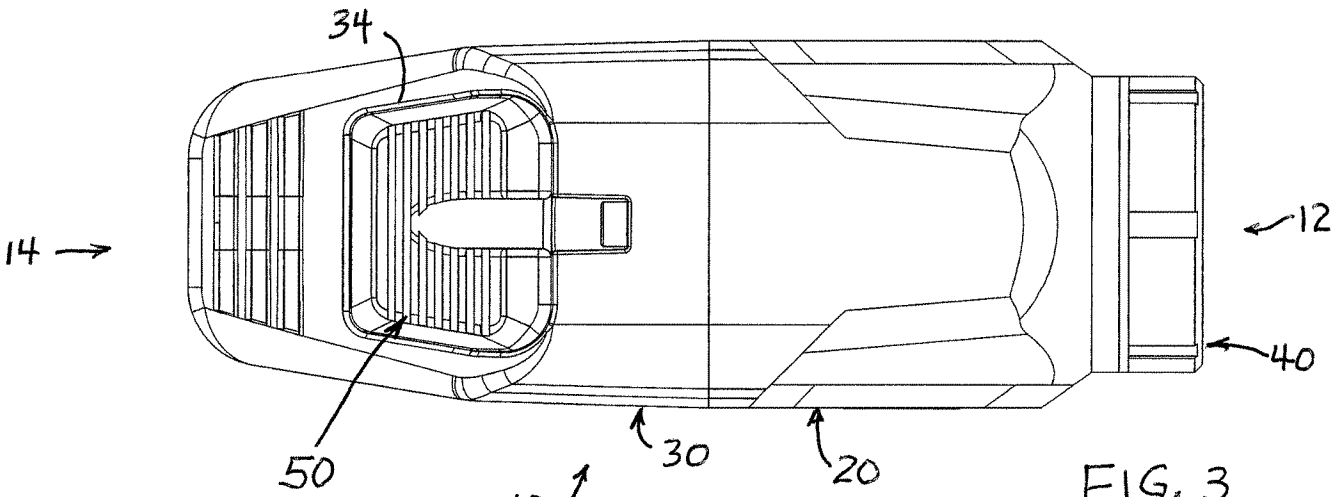
FIGS. 3 and 4 are views of two different sides of the example light of FIGS. 1-2.
Figure 4:
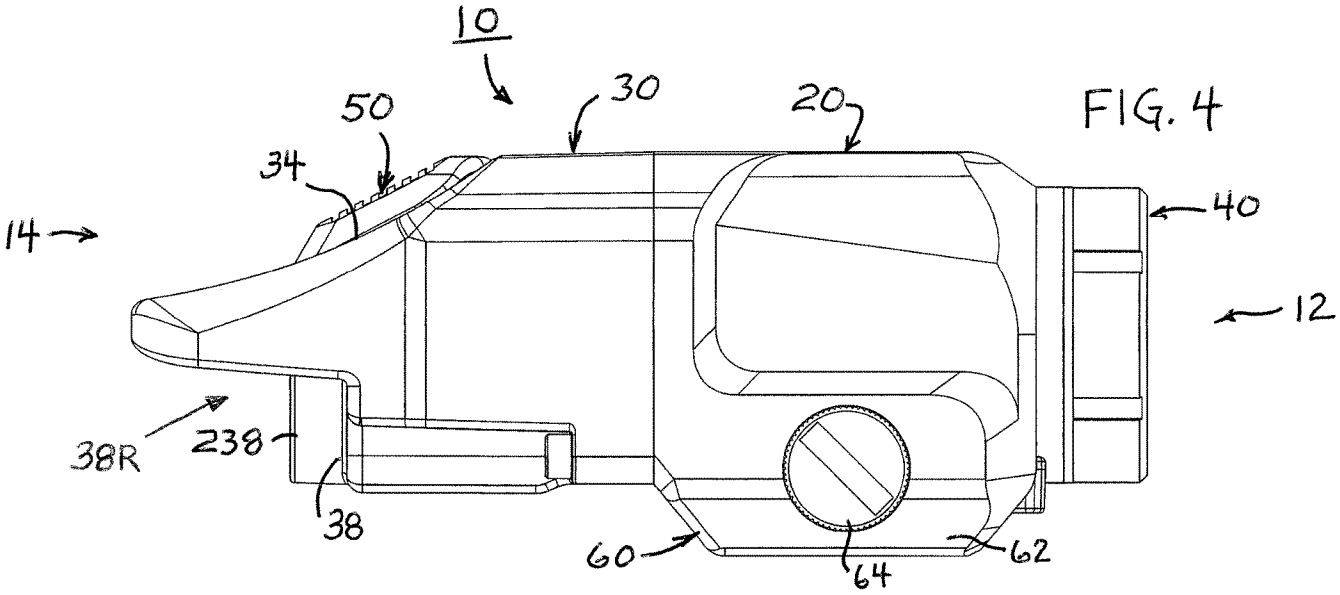
Figures 5A, 5B:
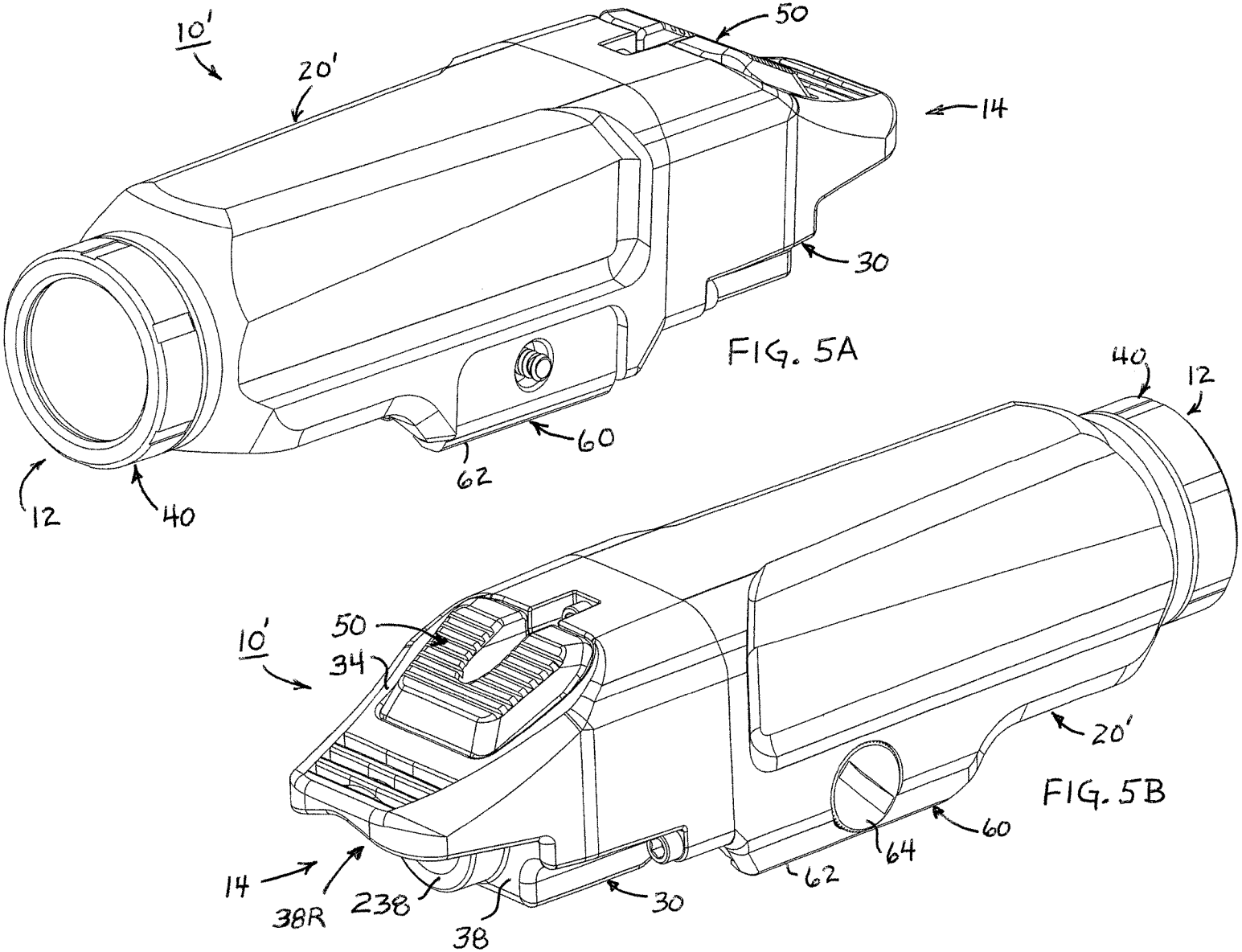
FIGS. 5A-5B and 5C-5D are perspective and side views, respectively, of an example embodiment of a light similar to the example light of FIGS. 1-4 and having a longer body.
Figure 5C:
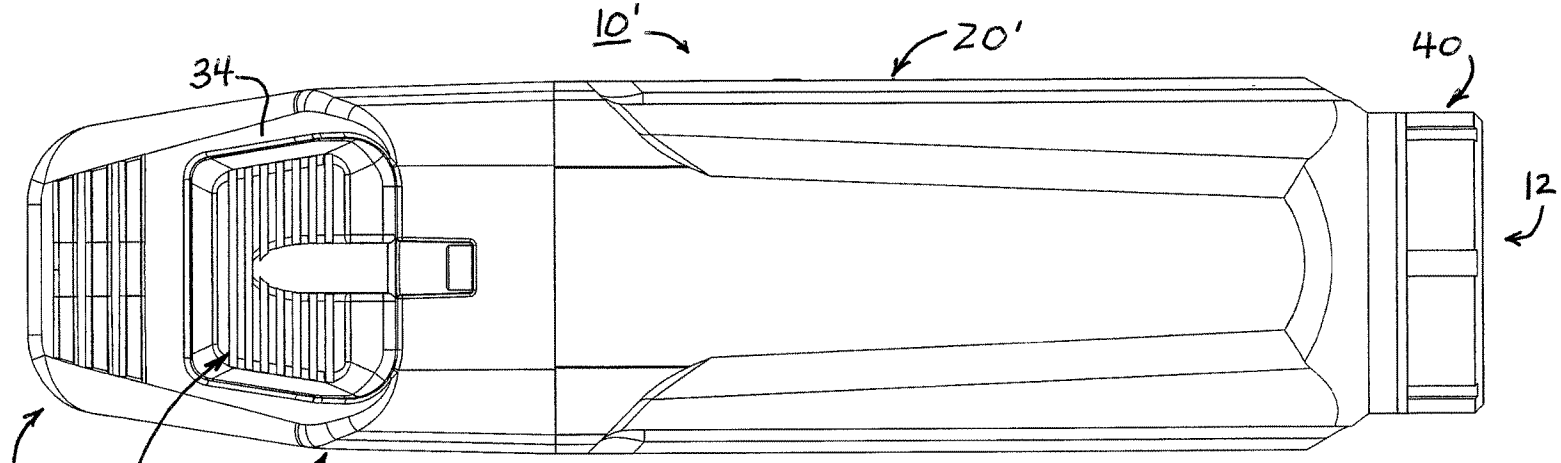
Figure 5D:
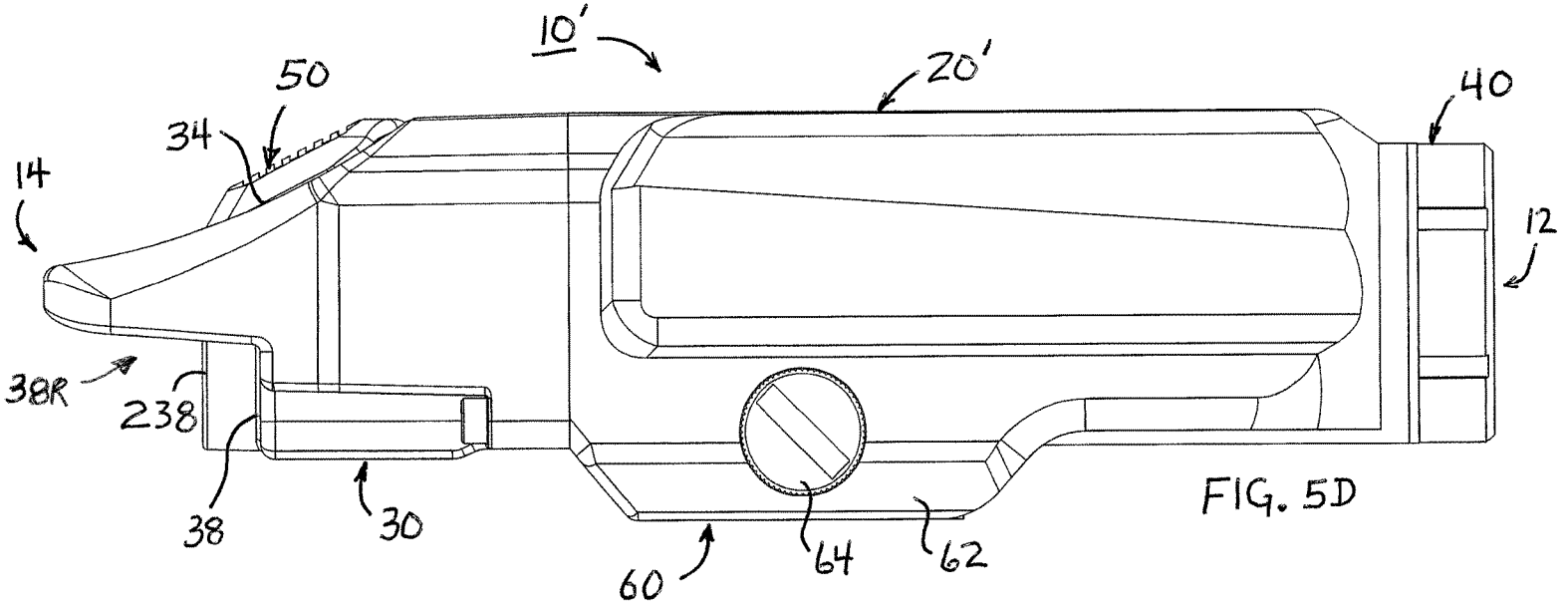
Figure 6B:
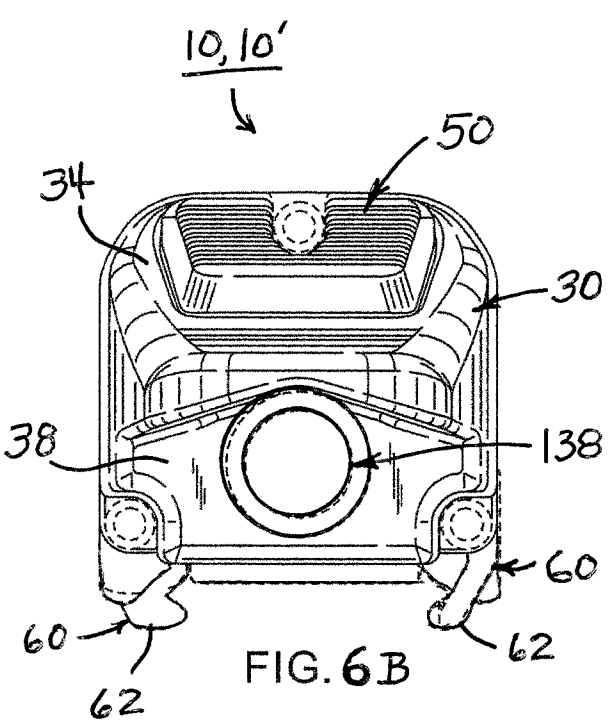
FIGS. 6A and 6B are views of the forward and rearward ends, respectively, of the example lights of FIGS. 1-5D.
Figure 6A:
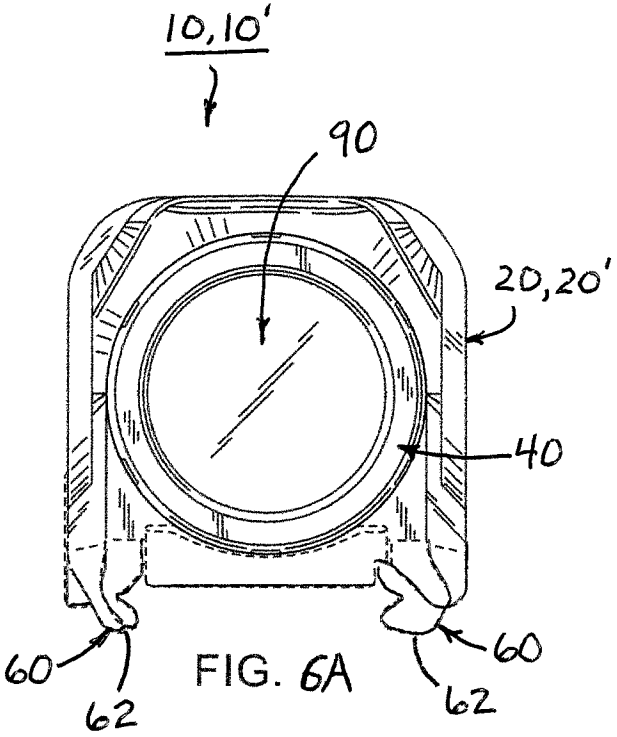

FIGS. 1 and 2 are two different perspective views of an example embodiment of a light 10 having a switch actuator 50 on the body 20 thereof and, optionally, a plug 238 for being inserted into a connector 138 for an external switch actuator; FIG. 2A is a perspective view of the example light 10 including the connector 238C; and FIGS. 3 and 4 are views of two different sides of the example light 10 of FIGS. 1-2. FIGS. 5A-5B and 5C-5D are perspective and side views, respectively, of an example embodiment of a light 10' similar to the example light 10 of FIGS. 1-4 and having a longer body 20'. FIGS. 6A and 6B are views of the forward 12 and rearward ends 14, respectively, of the example lights 10, 10' of FIGS. 1-5D.

Light 10, 10' includes a light body 20, 20' having a light head 40 including a light source 90 at the forward end 12 thereof and having a clamping arrangement 60 at one side thereof, e.g., for mounting light 10 to a firearm, e.g., to a mounting rail thereof. A tail cap 30 at the rearward or tail end 14 thereof includes an electrical switch, e.g., including an internal electrical switch 150 and an external switch actuator 50 therefor which may be pressed and released for actuating the internal electrical switch for selectively energizing and de-energizing light source 90, and/or controlling various operating modes thereof, e.g., brighter, dimmer, flashing, strobing, and the like.

Light body 20, 20' typically includes a housing 20 defining an internal cavity 24 into which a source of electrical power, e.g., one or more batteries, is placed for providing electrical energy for selectively energizing the light source 90 responsive to the internal electrical switch. Access to the internal cavity, e.g., for placing and/or removing the power source, may be by removing the tail cap 30 and/or by removing the light head 40 which includes light source 90, as may be convenient and/or desirable.

Example light 10 has a light body 20 including a housing 22 defining an internal cavity 24 for receiving, e.g., one or more batteries, while the example light 10' has a longer light body 20' including a housing 22' defining a longer internal cavity 24 for receiving, e.g., two or more batteries. Light 10, 10' may be configured to employ a different and/or greater number of batteries and/or to employ different types and kinds of light sources 90.

Clamping arrangement 60 typically grasps a mounting rail or other feature of a firearm for mounting light 10, 10' thereon, in a direction whereat light 10, 10' directs light forwardly, e.g., in the same direction as the longitudinal axis 16 of the barrel of the firearm. Clamping arrangement 60 typically has a pair of opposing clamp members 62 that grip a mounting rail of a firearm and a mechanism 64 for securing the light 10, 10' thereon, e.g., typically a screw or spring biased member.

Tail cap 30 includes an externally actuatable actuator 50 for actuating an internal electrical switch 150 and optionally, a connector 138 to which a cable for a remote switch may be may be connected. Typically the remote switch operates light 10, 10' in like manner as does the electrical switch internal to tail cap 30. Tail cap 30 is typically attached to light housing 22 by one or more fasteners, e.g., three screws in the illustrated example embodiment.

Preferably, tail cap 30 has an angled actuator 50 that is disposed to actuate an electrical switch disposed internally to tail cap 30 when actuator 50 is pressed, e.g., by a user's finger, in a forward direction along light body 20, 20', e.g., from rear end 14 towards forward end 12, and in a direction transverse to light body 20, 20', e.g., downward in FIGS. 1-3 and 5A-5C, towards clamp member 60, and may also be actuated by pressing on actuator 50 at angles between those forward and transverse directions.

Typically, and preferably, actuator 50 has an actuation surface that is at an acute angle relative to both the forward direction and the transverse direction and is at an acute angle A relative the direction of a longitudinal axis 16 of light 10, 10'.

Typically, and preferably, tail cap 30 has an exterior surface 34 that is at an angle relative to both the forward direction and the transverse direction along which actuator 50 may be pressed, and actuator 50 may be disposed on the angled surface 34. In other words, the actuator 50 and the angled surface 34 are each typically at a respective acute angle relative to the longitudinal axis 16 of light 10, 10' and to a transverse direction thereof. In the illustrated example embodiment, actuator 50 and surface 34 are typically at about the same acute angle A, but need not be. Being able to actuate light 10, 10' at angles between the forward and transverse directions is considered to be a desirable feature, e.g., where light 10, 10' may be mounted to a barrel of a long arm such as a rifle or shotgun.

In addition, having provision for employing a remote switch with light 10, 10' is considered a desirable feature for long gun users, thereby enabling the user the option of actuating light 10, 10' by pressing actuator 50 using a finger of a hand that is holding the barrel of the long gun near to light 10, 10' or of actuating light 10, 10' using a remote switch, e.g., a switch mounted near the trigger of the long gun rather than using actuator 50 on tail cap 30.

To that end, tail cap 30 may also include an electrical connector 138 for receiving a plug 238 that may be mated therewith. Plug 238 may be a sealing plug 238S for closing the electrical connector 138 to reduce the ability of debris and moisture entering therein. Plug 238 may also be a mating external electrical connector 238C which is at one end of an electrical cable that has an electrical switch at the remote opposite end thereof, commonly referred to as a remote switch. Sealing plug 238S may be tethered to tail cap 30 to reduce the likelihood that it becomes lost.

The rearward end of tail cap 30 may have, and preferably does have, an undercut recess defining a transverse surface 38 having electrical connector 138 therein, e.g., a socket connector 138 recessed into tail cap 30, with which external electrical connector 238C of the remote switch, e.g., a plug connector 238C, can mate. Electrical connector 238C when mated with connector 138 is then typically in the undercut recess 38R of tail cap 30 so as to be between the longitudinal surface of that recess 38R and the barrel of the long gun where it is out of the way. In particular, the connector 138 and plug 238 therein is located in the undercut recess 38R between the underside of tail cap 30 and a mounting rail (not shown) on a firearm to which light 10, 10' is mounted, and so are disposed in a relatively protected location.

Being in the undercut of that recess 38R, the connector 138 of light 10, 10' as well as the plug 238, whether a sealing plug 238S or an electrical connector 238C, are relatively protected, e.g., by the rearward extension of tail cap 30, from being bumped or otherwise physically disturbed and/or dislodged. This arrangement also is seen to allow light 10, 10' to have a lower profile, e.g., to extend a smaller distance from the mounting rail, than in a conventional arrangement where the connector is typically located in a relatively flat rear surface of the light. Typically, the recess 38R while referred to as undercut because it is beneath the rearward extension of tail cap 30, it is not cut, but is part of the molded or machined body of tail cap 30.

External electrical connector 238C and its electrical cable and the electrical switch at the distal end thereof are typically referred to as a "remote switch." Examples of such remote switches include, e.g., the TLR® Remote Switches for long guns that are available from Streamlight, Inc. of Eagleville, Pa.

Figure 7A:
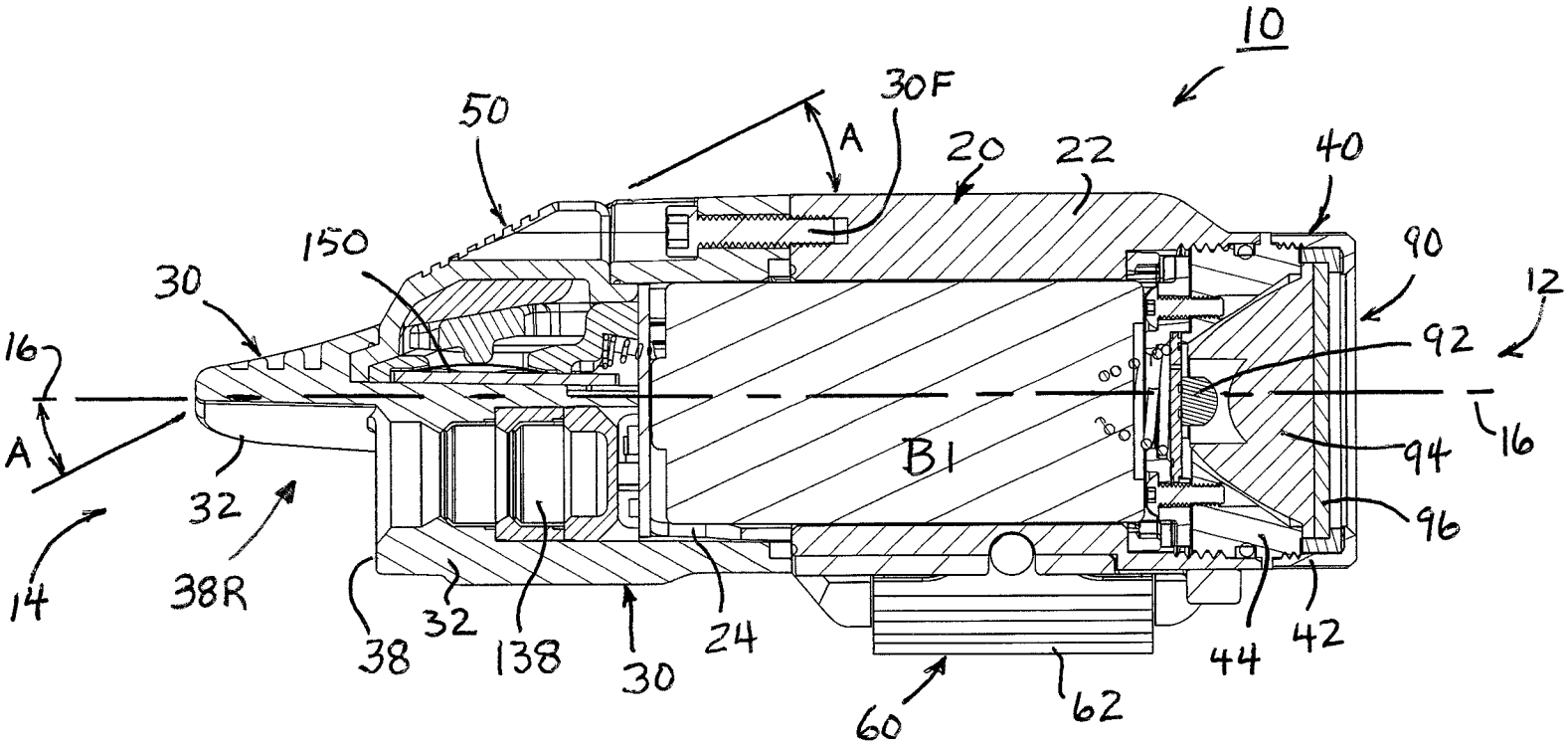
FIGS. 7A and 7B are side longitudinal cross-sectional views of the example lights of FIGS. 1-4 and 5A-5D, respectively, showing various internal features thereof.
Figure 7B:
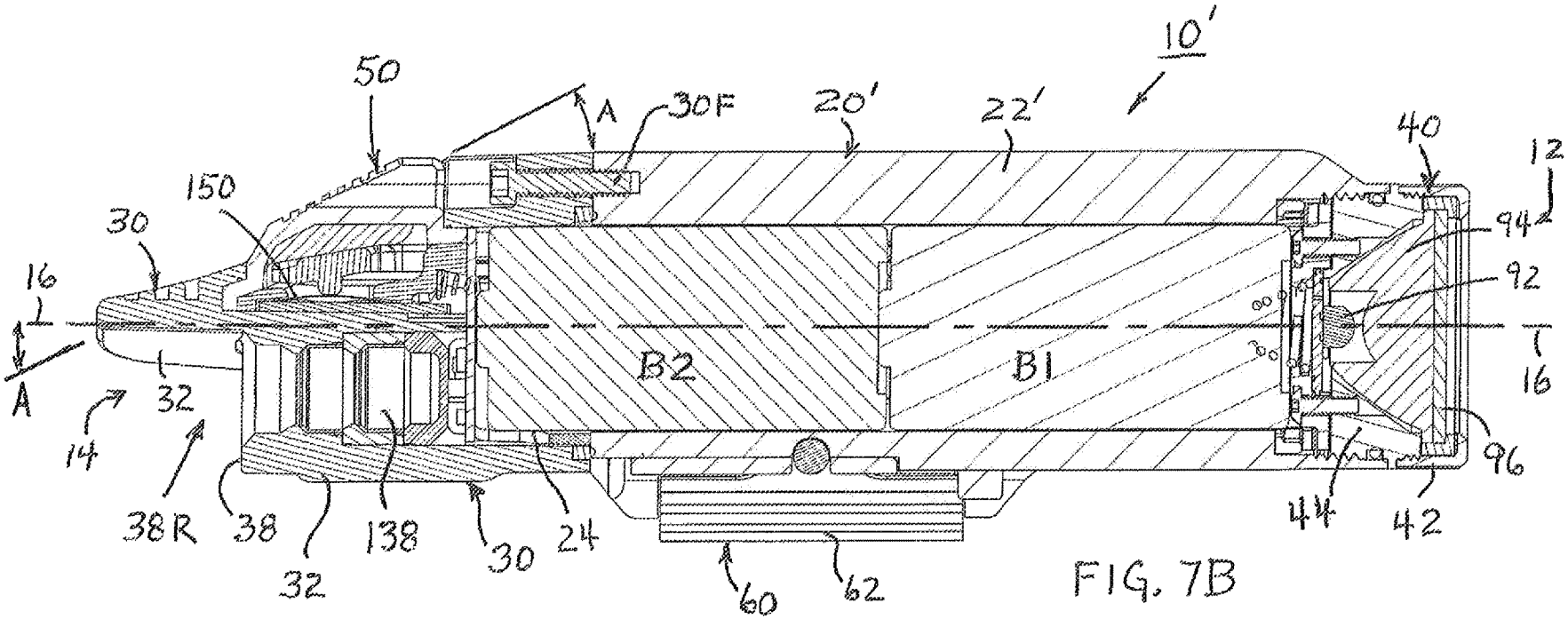
Figure 7C:
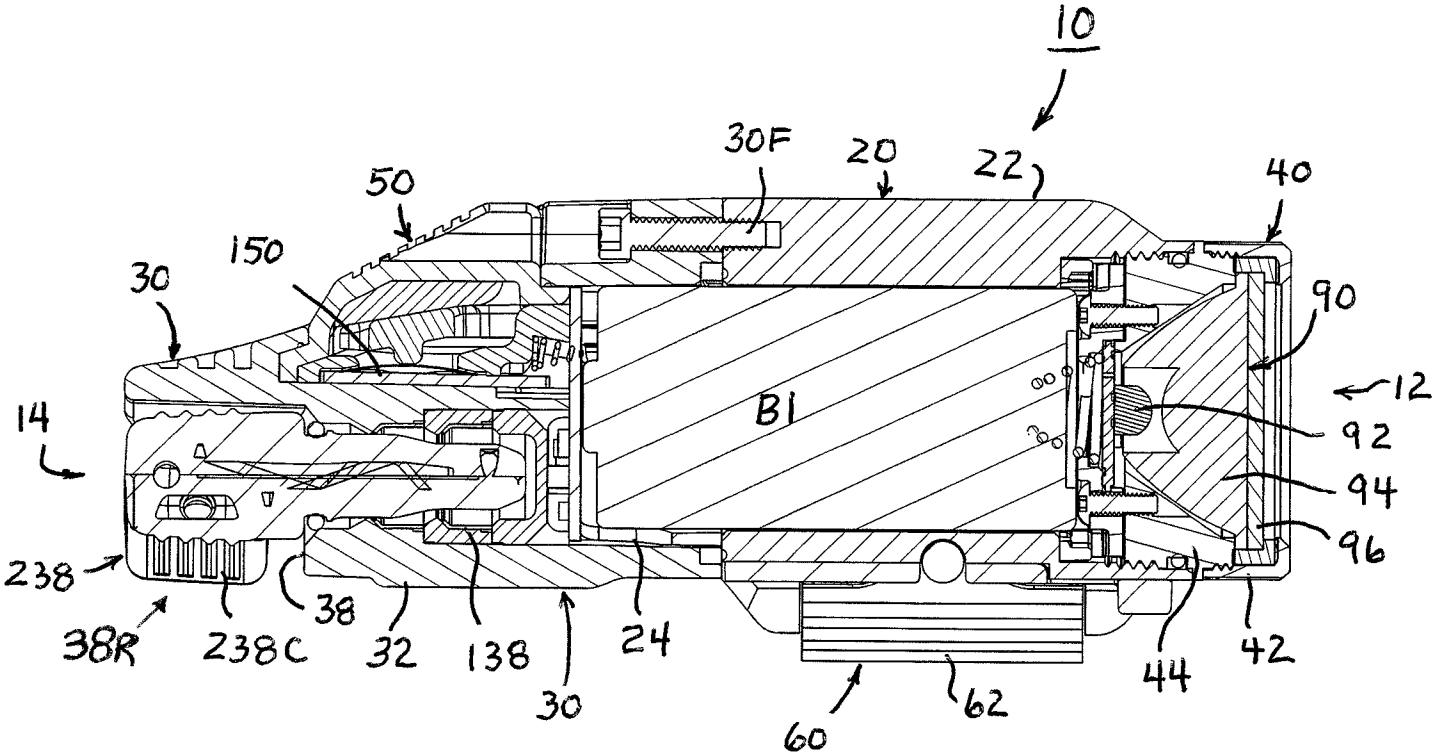
FIG. 7C is a side cross-sectional view thereof with the connector present.
Figure 8:
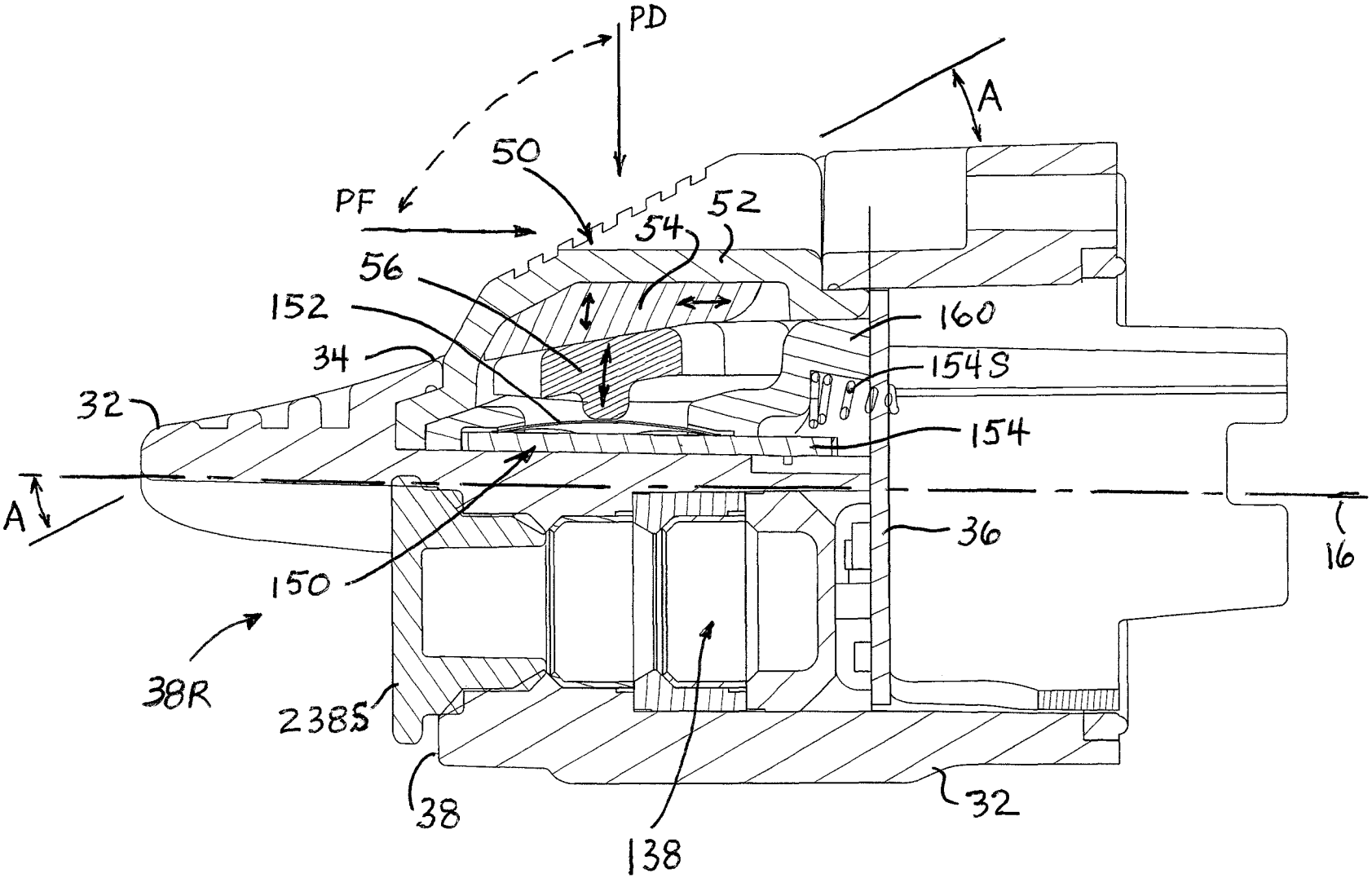
FIG. 8 is an enlarged cross-sectional view of the rearward or tail end thereof including the actuator and switch thereof.
Figure 9A:
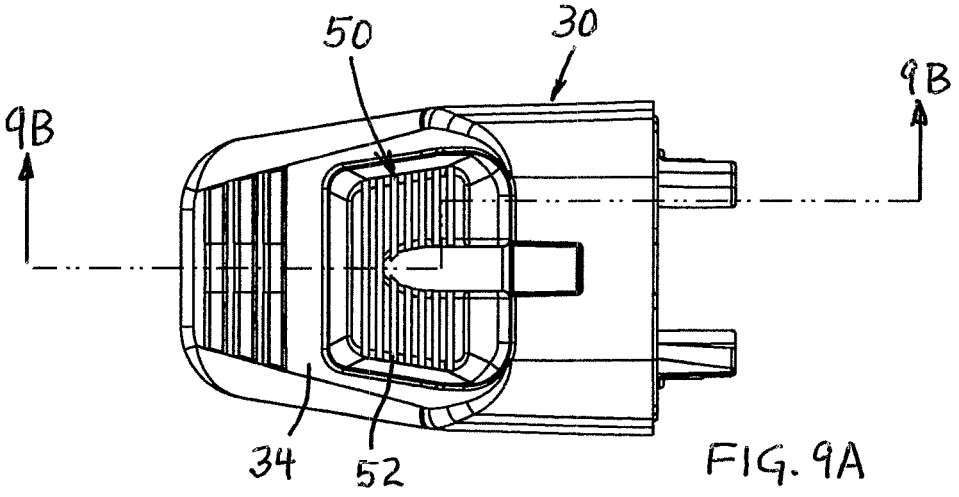
FIG. 9A is a is a view of the example tail cap of the example light and FIG. 9B is a cross-sectional view thereof along the dashed line 9B-9B of FIG. 9A.
Figure 9B:
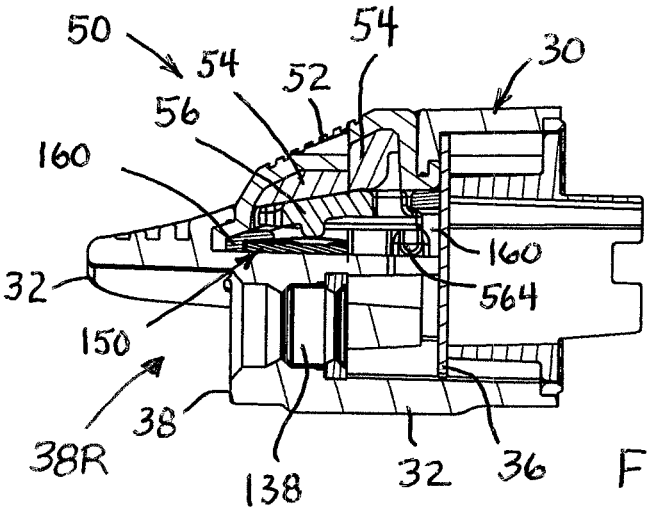
Figure 10A:
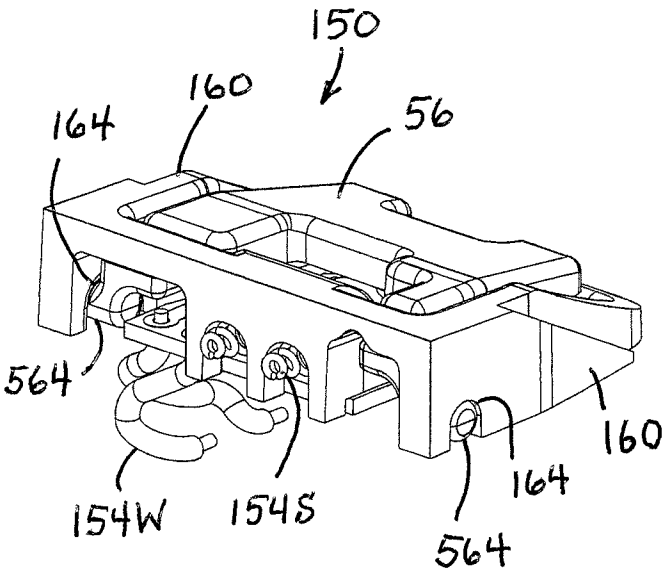
FIGS. 10A and 10B are perspective views of an example embodiment of a switch assembly of the example light and FIG. 10C is an exploded view thereof.
Figure 10B:
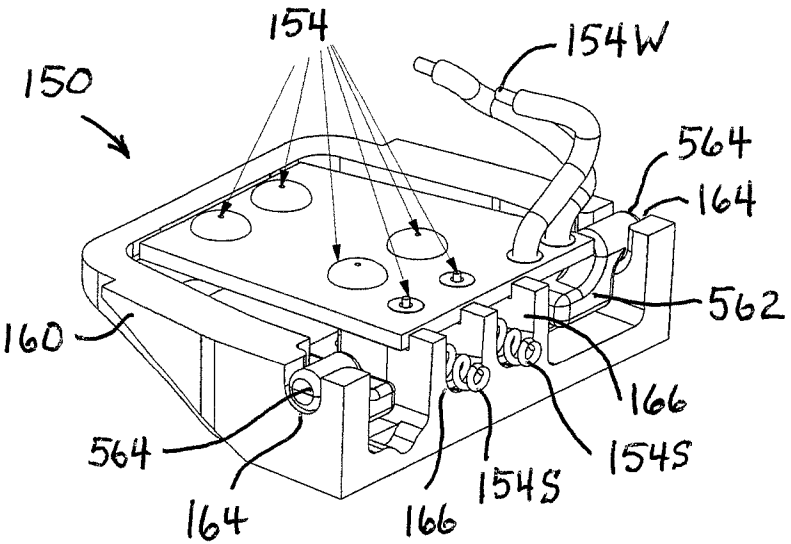
Figure 10C:
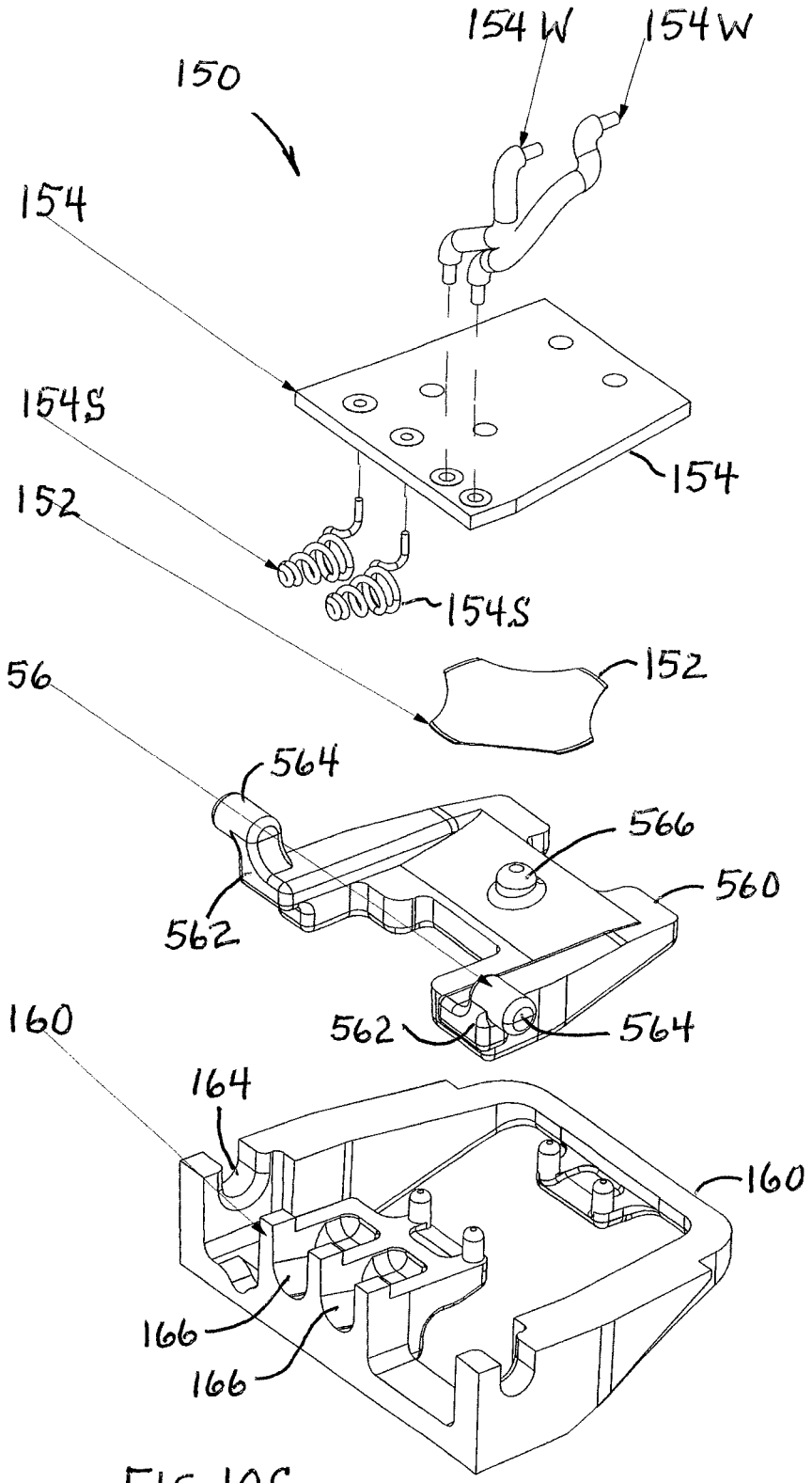

FIGS. 7A and 7B are side longitudinal cross-sectional views of the example lights 10, 10' of FIGS. 1-4 and 5A-5D, respectively, showing various internal features thereof, FIG. 7C is a side cross-sectional view thereof with the connector 238C present; FIG. 8 is an enlarged cross-sectional view of the rearward or tail end 14 thereof including the tail cap 30, actuator 50 and electrical switch 150 thereof. FIG. 9A is a is a view of the example tail cap 30 of the example light and FIG. 9B is a cross-sectional view thereof along the dashed line 9B-9B of FIG. 9A; and FIGS. 10A and 10B are perspective views of an example embodiment of a switch assembly 150 of the example light 10, 10' and FIG. 9C is an exploded view thereof.

Example lights 10 and 10' differ in that example light 10 has a relatively shorter housing 22 that accommodates, e.g., a single battery B1, and example light 10' has a relatively longer housing 22' that accommodates, e.g., two batteries B1, B2, and so the description applies to both lights.

Light head 40 at the forward end 12 of light 10, 10' includes a lens ring 42 that retains elements of light source 90 in light head housing 44 behind lens 96. Light source 90 includes a light emitting element 92, e.g., a light emitting diode 92, that when energized emits light into an optical element 94 to provide a beam of light having desired characteristics, e.g., beamwidth and/or shape. Optical element 94 may be, e.g., a curved reflector 94 or a totally internally reflective (TIR) optical element 94 as illustrated. Lens ring 42 is threaded onto housing 44 to retain optical element 94 and LED 92 including its support in light head 40. Head housing 44 threads into light housing 22, 22'. A spring contact at the rearward end of light head 40 makes electrical contact to the forward end of the battery B1 and/or B2 in housing 22. 22'.

Example light 10 has a light body 20 including housing 22 defining an internal cavity for receiving, e.g., a single battery B1, typically a CR-123 battery, while the example light 10' has a longer light body 20' defining a longer internal cavity for receiving, e.g., two batteries B1 and B2, typically two CR-123 batteries connected in series. A light 10, 10' may be configured to employ a different and/or greater number of batteries, and to employ other types and kinds of batteries, e.g., AA or AAA batteries, single use or rechargeable batteries, as may be considered desirable.

Tail cap 30 abuts and/or fits with housing 22, 22' and is retained in place thereon by one or more fasteners, e.g., screws 30F. Tail cap housing 32 contains the functional elements of tail cap 30 and provides various exterior surfaces lending to the functionality and convenience of light 10, 10'. Angled surface 34 slopes downward from what is the top of light 10, 10' in the Figures towards the side of light 10 having the clamping arrangement 60 thereon. The rearward 14 end of tail cap housing 32 may have an undercut recess that defines a surface 38 that is substantially transverse to longitudinal axis 16, thereby to provide a convenient location for an optional connector 138 with which an external connector 238C of a remote switch can be mated.

Angled surface 34 is at an acute angle A with respect to the longitudinal axis 16 of light 10, 10'. The exposed surface of flexible actuator boot 52 is also at an angle, e.g., generally and approximately similar to that of angled surface 34. To actuate electrical switch 150 which is disposed internally to tail cap 30, actuator 50 may be pressed forwardly from the rearward end of light 10, 10' (e.g., parallel to longitudinal axis 16) as depicted by the arrow labeled PF, or may be pressed inwardly (e.g., downwardly or in a transverse direction) towards light 10, 10' (e.g., transversely or perpendicularly to longitudinal axis 16) as depicted by the arrow labeled PD, or may be pressed at any direction between those depicted by arrows PF and PD (as indicated by the dashed double-ended arrow). That pressing of actuator 50 is coupled as downward pressure against switch 150 by actuator elements 52, 54, 56.

Electrical switch 150 preferably includes a circuit board 154 that is disposed on an internal surface of tail cap housing 32 that is substantially parallel to longitudinal axis 16. Circuit board 154 has plural switch contacts thereon and a snap dome element 152 that is disposed adjacent to circuit board 154 over those contacts so as to make electrical connection between ones of the electrical contacts of circuit board 154 when snap dome 152 is deformed and its dome snaps inwardly towards circuit board 154.

Circuit board 154 which supports switch 150 is preferably disposed on an internal surface of housing 32 that substantially parallel to longitudinal axis 16 and so circuit board 154 and switch 150 are substantially parallel to longitudinal axis 16, thereby avoiding the need for any supporting structure therefor. The internal surface on which electrical switch 150 is disposed and/or the circuit board 154 define a reference plane; and in the illustrated example embodiment, the reference plane is parallel to the longitudinal axis 16.

Electrical switch 150 may employ different forms of switch contacts and switching elements. For example, snap dome 152 may have plural legs of the same length so as to provide a simply open-closed switching function, or snap dome 152 may have three longer legs and one shorter leg to provide a two-step switching operation, a first when pressed to deform sufficiently for the shorter leg to contact a first electrical contact of circuit board 154 and a second when pressed harder to further deform sufficiently for the center of snap dome 152 to snap towards and to contact a second electrical contact of circuit board 154. Alternatively, commercially available electrical switches may be employed, and may be adapted by having a platform on the actuator thereof against which plunger 56 bears.

Flexible boot 52 of actuator 50 is accessible externally to tail cap 30 because the actuation surface thereof, e.g., a ribbed surface, extends into an opening in angled surface 34 of light body 20, 20' and the periphery of flexible boot 52 is between the interior surface of tail cap housing 32 and internal elements thereof, e.g., switch housing 160, to be retained in position therein and to provide a seal. The interior surface of flexible boot 52 is generally parallel to its outer or actuation surface, e.g., is an acute angle relative to longitudinal axis 16, whereby the pressing force applied thereto is applied to actuator member 54. The offset cross-sectional view of FIG. 9B illustrates the shape of flexible boot 52 apart from the slot in the central upper region thereof for providing access to a centrally located one of fasteners 30F that retain tail cap 30 adjacent light body housing 22, 22' and other features of actuator assembly 50 and of switch assembly 150.

Actuator member 54 has an upper surface that is angled similarly to the interior surface of flexible boot 52 and a lower surface that is angled at an acute angle that is less than the angle of flexible boot 52, e.g., less than angle A, and preferably may be about one-quarter to one-half of angle A. Actuator member 54 is disposed in a space that permits it to move, e.g., pivot, substantially transversely to longitudinal axis 16, i.e. towards switch 150, in response to pressure applied to actuator 50 at flexible boot 52. Actuator member 54 bears against plunger 56 which is pivoted as described below, and so the primary motion of actuator member 54 tends to also be pivotal over a small angle along with plunger 56.

Transversely directed pressure PD clearly on boot 52 results in pivotal movement of actuator member 54 and plunger 56 over a small angle and so the movement is substantially transverse to longitudinal axis 16 of light 10, 10' as is also the case for forwardly directed pressure PF, although forwardly directed pressure PF may also produce some slight movement of actuator member forwardly, i.e. parallel to longitudinal axis 16. In any case, movement of actuator member 54 tends to apply force to plunger 56 in a direction towards switch 150.

Switch assembly 150 includes a switch housing 160 that is configured to receive plunger 56 and circuit board 154. Plunger 56 has a body 560 from which one or more arms 562, e.g., a pair of arms 562, extend and one or more coaxial pivot axles 564 extend outwardly from the one or more arms 562. One or more coaxial pivot recesses 164, e.g., a pair of coaxial pivot recesses 164, in switch housing 160 receive respective pivot axles 564 when plunger 56 is disposed in switch housing 160. Thus, plunger 56 is pivotable in switch housing 160 about pivot axles 564 so that plunger projection 566 is movable, e.g., pivotable, towards and away from snap dome switch element 152 for making and breaking an electrical connection between the contacts of switch 150, e.g., between snap dome 152 and circuit board 254.

Thus, plunger 56 can pivot over a relatively small angle so that plunger projection 566 can move substantially transversely to longitudinal axis 16, i.e. towards and away from snap dome 152 of switch 150, in response to force applied via actuator member 54. The upper surface of plunger 56 is angled at about the same acute angle as is the lower surface of actuator member 54 against which it rests, whereby whether actuator member 54 pivots downwardly and/or moves slightly forwardly, that movement tends to pivot plunger 56 towards snap dome switch element 154 thereby to actuate switch 150.

Switch housing 160 has a recess in which circuit board 154 is disposed in a predetermined position and orientation so that snap dome element 152 is in the proper position relative to plunger 56, e.g., relative to projection 566 thereof, so that switch 150 properly actuates and de-actuates in response to the application and removal of pressure on actuator 50. Thus, circuit board 154 is substantially parallel to longitudinal axis 16 of light 10, 10'.

Circuit board 154 supports a pair of contact springs 154S that extend into cavity 24 of light housing 22, 22' to connect to a source of electrical power, e.g., one or more batteries B1, B2, therein, and switch housing 160 preferably has a pair of recesses 166 in which contact springs 154S are disposed in predetermined positions. One or more electrical conductors 154W, e.g., insulated wires 154W, extend from circuit board 154 for coupling electrical power and/or switched electrical power, from circuit board 154 to electrical circuitry elsewhere in light 10, 10' for energizing light source 90.

Returning to actuator 50, the bottom of plunger 56 preferably has a projection 566 thereon extending therefrom toward snap dome switch element 152 so as to apply force thereto at or near to the center of snap dome 152 for actuating snap dome 152 to deform inwardly towards circuit board 154 thereby to make electrical connection between various ones of the electrical contacts of circuit board 154, e.g., parts of an electrically conductive circuit pattern thereon.

As a result, pressure applied to flexible boot 52 in the direction PD tends move, e.g., pivot, actuator member 54 inwardly towards switch 150 so as to transfer force in substantially that direction and pressure applied to flexible boot in the direction PF also tends to move, e.g., pivot, actuator element 54 downwardly thereby to also direct force towards switch 150. Pressure applied in directions between PD and PF tend to produce a combination of those movements of actuator member 54 which again tends to direct force towards switch 150 via the pivoting movement of plunger 56 in switch housing 160. As a result, electrical switch 150 can be reliably actuated when pressure is applied to actuator 50 over a range of angles which may approach or exceed 90°, which includes directions PF and PD, and angles and directions therebetween.

Actuator member 54 and plunger 56 may be, and preferably are, made of a material that has properties that facilitate their movement relative to each other and/or to other elements of actuator assembly 50 and switch assembly 150. Alternatively, and optionally, the interfacing surfaces of actuator member 54 and of plunger 56 may be coated, greased or otherwise lubricated or treated so as to facilitate their movement relative to other elements of actuator 50, as may the interfacing surfaces of actuator member 54 and actuator boot 52 that bear against each other. In addition, a grease or lubricant may be applied to snap dome element 152 and/or to circuit board 154.

Where lubrication is needed or desired, a petroleum-based grease or lubricant, a graphite-based grease or lubricant, a silicone grease or lubricant, an electrical contact grease, a poly alkyl glycol grease, or any other suitable grease or lubricant, may be employed on these surfaces to reduce friction and facilitate relative movement of internal moving parts.

When provided, an example connector 138 as illustrated typically comprises a plurality of coaxial hollow cylindrical insulating members alternating with ones of a plurality of coaxial hollow cylindrical electrically conductive members of respective sizes so as to nest one inside another in a coaxial nested arrangement. Typically only two electrically conductive members, e.g., hollow cylindrical conductive members, may be needed with an insulating member therebetween, e.g., to provide two connections, however, connector 138 may include electrical contacts of any suitable configuration and may provide more than two connections. External switch connector 238C typically has connection surfaces and/or features that are complementary to those of connector 138 so as to mate therewith and make electrical connection thereto. Further, other types and kinds of electrical connectors 138 may be employed, e.g., multi-pin connectors.

External connector 238C is configured and sized similarly to connector 138 so as to be insertable therein and to mate therewith with its coaxial electrically conductive members making respective electrical connections to electrically conductive members of connector 138 when mated thereto. While the physical configuration of the switch contacts and actuator of the remote switch may take any desired form, the electrical contact function of the external remote switch is typically, and often desirably, the same as that of electrical switch 150. For example, where electrical switch 150 is a normally-open single-pole single-throw switch, then the remote switch is also a normally-open single-pole single-throw switch and preferably actuation thereof provides the same operating responses as does actuation of electrical switch 150.

A sealing plug 238S, typically of insulating material, and optionally tethered to light 10, 10', e.g., to tail cap 30, may be provided to be placed into connector 138 so as to reduce the entry of dirt, debris and/or moisture therein, e.g., when an external connector 238C is not mated with connector 138.

Circuit board 36 inside of tail cap 30 is disposed against positioning features interior to tail cap housing 32 and may be disposed transversely to longitudinal axis 16 as illustrated. Circuit board 36 includes an electrical contact for connecting to the rearward end of the source of electrical power, e.g., battery B1 or battery B2 of battery B1-B2. Circuit board 36 also connects to electrical switch 150 and to connector 138, when provided, e.g., so that electrical switch 150 and the remote switch are electrically connected in parallel to operate in like manners.

Control circuitry for the control and operation of light 10, 10' may be disposed on circuit board 150, on circuit board 36 and/or on another circuit board, as may be convenient. The control circuitry typically may include, e.g., a microprocessor or microcontroller, a current and/or voltage regulator, a DC converter, switch interface circuits, and the like. Such control circuitry serves to provide and/or condition electrical power from power source B1, B2 to light source 90 in a controlled manner consistent with proper and desired operation of light source 90 and in response to control inputs provided by a user actuating, e.g., pressing and releasing, actuator 50 to close and open electrical switch 150. Control of operating mode may be responsive to the number and/or timing of the openings and closings of switch 150.

In one example embodiment of tail cap 30, the angled external surface 34 may typically at an angle of about 28.5°, however, the angle A may be in a range of about 25° to 45° or even in a broader range of about 10° to 60°. Therein the angle between the upper and lower surfaces of actuation member 54 may be about half of the angle A or about 17.5° so that the angle of the lower surface of actuator member 54 is about 11° relative to longitudinal axis 16. In that instance the angle of the upper surface of plunger 56, which is preferably at about the same angle as is the lower surface of actuator member 54, is about 11° relative to longitudinal axis 16. The ranges of angles for each of the foregoing angles is generally proportional to the range of the angle for angled surface 34. While the respective angles and ranges may be stated in relation to the longitudinal axis 16 of light 10, 10', those angles and ranges are also relative to electrical switch 150, e.g., to the substrate or circuit board 154 thereof.

In a typical embodiment, the various housings 22, 22', 32, 42, internal parts 44, 52, 54, 56, 160 thereof and similar parts may be of a metal, e.g., aluminum, steel, brass, and the like, or of a plastic, e.g., a nylon, reinforced nylon, engineered nylon, Nylon 6, ABS, polycarbonate, polyethylene, a PC/PET plastic blend, ABS plastic, polypropylene, polycarbonate, polyester-polycarbonate blends and ABS polycarbonate blends (such as LEXAN® polycarbonate, XENOY polyester-polycarbonate blend and CYCALOY ABS polycarbonate blend), an acetal homopolymer (Such as DELRIN®), a PBT-PC blend (such as VALOX™ resin 508), acrylic, or may be a thermoplastic nylon or other elastomeric plastic such as that sold under the trademarks CAPRON® and NYPEL® or a thermoplastic elastomer compound or thermoplastic vulcanizate sold under the trademark NYLABOND®, or any other suitable plastic material, with or without a reinforcing material such as a fiberglass, carbon fiber or the like, and with or without a thermally conductive filler material and the like. Parts made of an electrically conductive material may be coated with an electrically insulating coating where and as necessary.

Optical elements 94 and lens 96 and similar parts may be of glass or any suitable clear plastic, e.g., a nylon, ABS, polystyrene, polycarbonate, acrylic, PMMA, or another suitable clear, transparent or translucent plastic or other suitable material. and the like. Resilient and/or flexible parts such as switch actuator boot 50, 52 and various seals and similar parts may be of a rubber or elastomer material, e.g., rubber, neoprene rubber, latex rubber, silicone rubber, silicone, SANTOPRENE® elastomer, and like resilient and/or flexible material.

A switch and light may comprise: a light body having a forward end and a rearward end, the light body defining a longitudinal axis and having an internal cavity for receiving a source of electrical power; a light source disposed at the forward end of the light body that produces light when energized; an electrical switch internal to the light body disposed adjacent to an internal surface thereof that is substantially parallel to the longitudinal axis, wherein the electrical switch is actuatable by being moved in a direction substantially perpendicular to the longitudinal axis; a switch actuator at the rearward end of the light body, the switch actuator may include a flexible boot disposed at an acute angle relative to the longitudinal axis; and the switch actuator may further include: a plunger adjacent to the electrical switch and movable in a direction substantially perpendicular to the longitudinal axis for actuating and de-actuating the electrical switch; and an actuator member disposed adjacent to the flexible boot between the flexible boot and the plunger, the actuator member having an angled surface adjacent to the plunger and being movable toward the plunger to move the plunger toward the electrical switch when the flexible boot is pressed toward the longitudinal axis and when the flexible boot is pressed in a direction substantially parallel to the longitudinal axis, wherein the electrical switch is actuated when the flexible boot is pressed toward the longitudinal axis, when the flexible boot is pressed substantially parallel to the longitudinal axis and when the flexible boot is pressed at an angle therebetween. The actuator member may have opposing surfaces that are at an acute angle relative to each other, wherein a first of the opposing surfaces is disposed adjacent to the flexible boot and a second of the opposing surfaces is disposed adjacent to the plunger to facilitate movement thereof. The plunger may have a first surface that is at an acute angle relative to the internal surface of the light body and that is disposed adjacent to the actuator member, and/or the plunger may have a projection extending toward the electrical switch. The electrical switch may include: a circuit board disposed adjacent to the internal surface and having a plurality of electrically conductive areas thereon, and a snap dome element adjacent to the circuit board, wherein the snap dome element is deformable for making an electrical connection between ones of the plurality of electrically conductive areas of the circuit board. The plunger may have a projection extending toward and adjacent to the the snap dome element of the electrical switch. The electrical switch may include a switch housing, wherein the switch housing has one or more coaxial pivot recesses and the plunger has one or more coaxial pivot axles respectively disposed in the one or more pivot recesses, whereby the movement of the plunger may include pivoting on the pivot axles. The movement of the actuator member may include pivoting with the plunger when the plunger pivots on the pivot axles. The electrical switch may include: a circuit board disposed having a plurality of electrically conductive areas thereon, and a snap dome element adjacent to the circuit board, wherein the snap dome element is deformable for making an electrical connection between ones of the plurality of electrically conductive areas of the circuit board; and wherein the switch housing supports the circuit board and the snap dome element adjacent to the internal surface of the light body that is substantially parallel to the longitudinal axis. The surface of the actuator member adjacent to the flexible boot and the angled surface thereof may define an acute angle that is substantially less than the acute angle of the flexible boot relative to the longitudinal axis. The acute angle between the flexible boot and the longitudinal axis may be in a range between about 10° and about 60°, or the acute angle between the surface of the actuator member adjacent the flexible boot and the angled surface of the actuator member may be in a range between about 5° and about 30°, or the acute angle between the flexible boot and the longitudinal axis may be in a range between about 10° and about 60° and the acute angle between the surface of the actuator member adjacent the flexible boot and the angled surface of the actuator member may be in a range between about 5° and about 30°. The acute angle between the flexible boot and the longitudinal axis may be in a range between about 25° and about 45°, or the acute angle between the surface of the actuator member adjacent the flexible boot and the angled surface of the actuator member may be in a range between about 5° and about 20°, or the acute angle between the flexible boot and the longitudinal axis may be in a range between about 25° and about 45° and the acute angle between the surface of the actuator member adjacent the flexible boot and the angled surface of the actuator member may be in a range between about 5° and about 20°. The acute angle between the flexible boot and the longitudinal axis may be about 28°-29°, or the acute angle between the surface of the actuator member adjacent the flexible boot and the angled surface of the actuator member may be about 10°-12°, or the acute angle between the flexible boot and the longitudinal axis may be about 28°-29° and the acute angle between the surface of the actuator member adjacent the flexible boot and the angled surface of the actuator member may be about 10°-12°. The light body may include: a clamping arrangement on a side thereof; or a clamping arrangement configured for grasping a firearm. The light body may include a tail cap, and wherein: the tail cap may include the switch actuator and the electrical switch; or the tail cap may include the flexible boot, the actuator member, the plunger and the electrical switch. The light body may include a clamping arrangement on a side thereof for grasping a firearm and has a recess near the rearward end thereof adjacent the side thereof having the clamping arrangement thereon, the light body may further include an electrical connector on a surface of the recess thereof for receiving in the recess an electrical connector of a remote switch therein, whereby the electrical connector of a remote switch is disposed between the rearward end of the light body and the firearm when the light is mounted to the firearm. A surface of the actuator member and/or a surface of the plunger may include a friction reducing material. The friction reducing material may be selected from the group consisting essentially of: a petroleum-based grease, a petroleum-based lubricant, a graphite-based grease, a graphite-based lubricant, a silicone grease, and a silicone lubricant.

A switch for a light may comprise: an electrical switch disposed on a surface that defines a reference plane, wherein the electrical switch is actuatable by being moved in a direction substantially perpendicular to the reference plane; a switch actuator may include a flexible boot disposed at an acute angle relative to the reference plane; the switch actuator may further include: a plunger adjacent to the electrical switch and movable in a direction substantially perpendicular to the reference plane for actuating and de-actuating the electrical switch; and an actuator member disposed adjacent to the flexible boot between the flexible boot and the plunger, the actuator member having an angled surface adjacent to the plunger and being movable toward the plunger to move the plunger toward the electrical switch when the flexible boot is pressed toward the reference plane and when the flexible boot is pressed in a direction substantially parallel to the reference plane, wherein the electrical switch is actuated when the flexible boot is pressed toward the reference plane, when the flexible boot is pressed parallel to the reference plane and when the flexible boot is pressed at an angle therebetween. The switch for a light may further comprise: a light body having a forward end and a rearward end, the light body having an internal cavity for receiving a source of electrical power; and a light source disposed at the forward end of the light body that produces light when energized; wherein the electrical switch is disposed internally to the light body on a surface that is substantially parallel to the reference plane, whereby the electrical switch is actuatable by being moved in the direction substantially perpendicular to the reference plane. The actuator member may have opposing surfaces that are at an acute angle relative to each other, wherein a first of the opposing surfaces is disposed adjacent to the flexible boot and a second of the opposing surfaces is disposed adjacent to the plunger to facilitate movement thereof. The plunger may have a first surface that is at an acute angle relative to the reference plane and that is disposed adjacent to the actuator member, and/or the plunger has a projection extending toward the electrical switch. The electrical switch may include: a circuit board disposed adjacent to the surface that defines the reference plane and having a plurality of electrically conductive areas thereon, and a snap dome element adjacent to the circuit board, wherein the snap dome element is deformable for making an electrical connection between ones of the plurality of electrically conductive areas of the circuit board. The plunger may have a projection extending toward and adjacent to the snap dome element of the electrical switch. The electrical switch may include a switch housing, wherein the switch housing has one or more coaxial pivot recesses and the plunger has one or more coaxial pivot axles respectively disposed in the one or more pivot recesses, whereby the movement of the plunger may include pivoting on the pivot axles. The movement of the actuator member may include pivoting with the plunger when the plunger pivots on the pivot axles. The electrical switch may include: a circuit board disposed having a plurality of electrically conductive areas thereon, and a snap dome element adjacent to the circuit board, wherein the snap dome element is deformable for making an electrical connection between ones of the plurality of electrically conductive areas of the circuit board; and wherein the switch housing supports the circuit board and the snap dome element adjacent to the surface that defines the reference plane. The surface of the actuator member adjacent to the flexible boot and the angled surface thereof may define an acute angle that is substantially less than the acute angle of the flexible boot relative to the reference plane. The acute angle between the flexible boot and the reference plane may be in a range between about 10° and about 60°, or the acute angle between the surface of the actuator member adjacent the flexible boot and the angled surface of the actuator member may be in a range between about 5° and about 30°, or the acute angle between the flexible boot and the reference plane may be in a range between 10° and about 60° and the acute angle between the surface of the actuator member adjacent the flexible boot and the angled surface of the actuator member may be in a range between about 5° and about 30°. The acute angle between the flexible boot and the reference plane may be in a range between about 25° and about 45°, or the acute angle between the surface of the actuator member adjacent the flexible boot and the angled surface of the actuator member may be in a range between about 5° and about 20°, or the acute angle between the flexible boot and the reference plane may be in a range between about 25° and about 45° and the acute angle between the surface of the actuator member adjacent the flexible boot and the angled surface of the actuator member may be in a range between about 5° and about 20°. The acute angle between the flexible boot and the reference plane may be about 28°-29°, or the acute angle between the surface of the actuator member adjacent the flexible boot and the angled surface of the actuator member may be about 10°-12°, or the acute angle between the flexible boot and the reference plane may be about 28°-29° and the acute angle between the surface of the actuator member adjacent the flexible boot and the angled surface of the actuator member may be about 10°-12°. The light body may include: a clamping arrangement on a side thereof; or a clamping arrangement configured for grasping a firearm. The light body may include a tail cap, and wherein: the tail cap may include the switch actuator and the electrical switch; or the tail cap may include the flexible boot, the actuator member, the plunger and the electrical switch. The light body may include a clamping arrangement on a side thereof for grasping a firearm and has a recess near the rearward end thereof adjacent the side thereof having the clamping arrangement thereon, the light body may further include an electrical connector on a surface of the recess thereof for receiving in the recess an electrical connector of a remote switch therein, whereby the electrical connector of a remote switch is disposed between the rearward end of the light body and the firearm when the light is mounted to the firearm. A surface of the actuator member and/or a surface of the plunger may include a friction reducing material. The friction reducing material may be selected from the group consisting essentially of: a petroleum-based grease, a petroleum-based lubricant, a graphite-based grease, a graphite-based lubricant, a silicone grease, and a silicone lubricant.

A switch and light may comprise: a light body having a forward end and a rearward end, the light body defining a longitudinal axis and having an internal cavity for receiving a source of electrical power; a light source disposed at the forward end of the light body that produces light when energized; an electrical switch internal to the light body disposed adjacent to an internal surface thereof that is substantially parallel to the longitudinal axis, wherein the electrical switch is actuatable by being moved in a direction substantially perpendicular to the longitudinal axis, wherein the electrical switch may comprise: a switch housing having an opening therethrough and having one or more coaxial pivot recesses; a plunger supported by the switch housing, the plunger having first and second opposing sides and having one or more pivot axles respectively disposed in the one or more coaxial pivot recesses of the switch housing, whereby the movement of the plunger includes pivoting on the pivot axles in the opening of the switch housing for actuating and de-actuating the electrical switch; and a flexible boot disposed adjacent to the first side of the plunger wherein pressing the flexible boot causes the plunger to pivot relative to the switch housing and the second side of the plunger to move toward the electrical switch to actuate the electrical switch; whereby the electrical switch is actuated when the flexible boot is pressed. The switch and light may further comprise: a circuit board disposed adjacent the opening of the switch housing and having an electrical switch element thereon, wherein the electrical switch element is actuatable by being pressed in a direction toward the circuit board. The electrical switch may include: a circuit board disposed adjacent to the internal surface and having a plurality of electrically conductive areas thereon, and a snap dome element adjacent to the circuit board, wherein the snap dome element is deformable for making an electrical connection between ones of the plurality of electrically conductive areas of the circuit board. The plunger may have a projection extending toward the snap dome element of the electrical switch. The switch housing may support the circuit board and the snap dome element adjacent to the internal surface of the light body that is substantially parallel to the longitudinal axis. The flexible boot may be adjacent to a first surface of the plunger that is at an acute angle relative to the internal surface of the light body, and/or the plunger may have a projection extending toward the electrical switch. The acute angle between the flexible boot and the longitudinal axis may be in a range between about 10° and about 60°. The acute angle between the flexible boot and the longitudinal axis may be in a range between about 25° and about 45°. The acute angle between the flexible boot and the longitudinal axis may be about 28°-29°. The light body may include: a clamping arrangement on a side thereof; or a clamping arrangement configured for grasping a firearm. The light body may include a tail cap, and the tail cap may include the flexible boot, the plunger and the electrical switch. The light body may include a clamping arrangement on a side thereof for grasping a firearm and has an electrical connector for receiving therein an electrical connector of a remote switch. A surface of the plunger may include a friction reducing material. The friction reducing material may be selected from the group consisting essentially of: a petroleum-based grease, a petroleum-based lubricant, a graphite-based grease, a graphite-based lubricant, a silicone grease, and a silicone lubricant.

A switch for a light may comprise: a switch housing having an opening therethrough and having one or more coaxial pivot recesses; a circuit board disposed adjacent the opening of the switch housing and having an electrical switch thereon, wherein the electrical switch is actuatable by being pressed in a direction toward the circuit board; a plunger supported by the switch housing, the plunger having first and second opposing sides and having one or more pivot axles respectively disposed in the one or more coaxial pivot recesses of the switch housing, whereby the movement of the plunger includes pivoting on the pivot axles in the opening of the switch housing for actuating and de-actuating the electrical switch; and a flexible boot disposed adjacent to the first side of the plunger wherein pressing the flexible boot causes the plunger to pivot relative to the switch housing and the second side of the plunger to move toward the circuit board to actuate the electrical switch; whereby the electrical switch is actuated when the flexible boot is pressed toward the circuit board. The first side of the plunger may be at an acute angle relative to the circuit board and wherein the second side of the plunger may have a projection extending toward the electrical switch. The electrical switch may include: a snap dome element adjacent to the circuit board, wherein the snap dome element is deformable for making an electrical connection between ones of a plurality of electrically conductive areas of the circuit board. The plunger may have a projection extending from the second side thereof toward the snap dome element of the electrical switch. The first side of the plunger which is adjacent to the flexible boot and the second side thereof may define an acute angle that is less than the acute angle of the flexible boot relative to the circuit board. The acute angle between the flexible boot and the circuit board may be in a range between about 10° and about 60°. The acute angle between the flexible boot and the circuit board may be in a range between about 25° and about 45°. The acute angle between the flexible boot and the circuit board may be about 28°-29°. The switch for a light may further comprise: a light body having a forward end and a rearward end, the light body having an internal cavity for receiving a source of electrical power; and a light source disposed at the forward end of the light body that produces light when energized; wherein the circuit board is disposed internally to the light body adjacent to a surface that defines a reference plane, whereby the electrical switch is actuatable by being moved in the direction toward the reference plane. The light body may include a tail cap, and the tail cap may include the flexible boot, the plunger and the electrical switch. The light body may include: a clamping arrangement on a side thereof; or a clamping arrangement configured for grasping a firearm. The light body may further include an electrical connector on a surface thereof for receiving therein a complementary electrical connector of a remote switch.

A switch and light may comprise: a light body having a forward end and a rearward end, the light body having an internal cavity for receiving a source of electrical power; a light source disposed on the light body and that produces light when energized; an electrical switch internal to the light body disposed adjacent to an internal surface thereof, wherein the electrical switch is actuatable by being moved in a direction transverse to the internal surface, wherein the electrical switch may comprise: a switch housing having an opening therethrough and having one or more coaxial pivot recesses; a plunger pivotably supported by the switch housing, the plunger having first and second opposing sides and having one or more coaxial pivot axles respectively disposed in the one or more coaxial pivot recesses of the switch housing, whereby the movement of the plunger includes pivoting on the pivot axles in the opening of the switch housing for moving the second side thereof toward and away from the internal surface for actuating and de-actuating the electrical switch; and a flexible boot disposed adjacent to the first side of the plunger wherein pressing the flexible boot causes the plunger to pivot relative to the switch housing and the second side of the plunger to move toward the electrical switch to actuate the electrical switch; whereby the electrical switch is actuated when the flexible boot is pressed.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "front," "back," "rear," "side," "end," "top," "bottom," "up," "down," "left," "right," "upward," "downward," "forward," "backward," "under" and/or "over," "vertical," "horizontal," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

As used herein, the term "and/or" encompasses both the conjunctive and the disjunctive cases, so that a phrase in the form "A and/or B" encompasses "A" or "B" or "A and B." In addition, the term "at least one of" one or more elements is intended to include one of any one of the elements, more than one of any of the elements, and two or more of the elements up to and including all of the elements, and so, e.g., the phrase in the form "at least one of A, B and C" includes "A," "B," "C," "A and B," "A and C," "B and C," and "A and B and C."

A fastener as used herein may include any fastener or other fastening device that may be suitable for the described use, including threaded fasteners, e.g., bolts, screws and driven fasteners, as well as pins, rivets, nails, spikes, barbed fasteners, clips, clamps, nuts, speed nuts, cap nuts, acorn nuts, and the like. Where it is apparent that a fastener would be removable in the usual use of the example embodiment described herein, then removable fasteners would be preferred in such instances. A fastener may also include, where appropriate, other forms of fastening such as a formed head, e.g., a peened or heat formed head, a weld, e.g., a heat weld or ultrasonic weld, a braze, and adhesive, and the like.

As used herein, the terms "connected" and "coupled" as well as variations thereof may or may not be intended to be exact synonyms, but may also encompass some similar things and some different things. The term "connected" as indicated by its context may be used generally to refer to elements that have a direct electrical and/or physical contact to each other, whereas the term "coupled" as indicated by its context may be used generally to refer to elements that have an indirect electrical and/or physical contact with each other, e.g., via one or more intermediate elements, so as to cooperate and/or interact with each other, and may include elements in direct contact as well.

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable or other device. Such devices could include power sources including, but not limited to, fuel cells, super capacitors, solar cells, and the like. Any of the foregoing may be intended for a single use or for being rechargeable or for both, and/or plural ones thereof may be combined into a battery pack or battery assembly.

Various embodiments of a battery may have one or more battery cells, e.g., one, two, three, four, or five or more battery cells, as may be deemed suitable for any particular device. A battery may employ various types and kinds of battery chemistry types, e.g., a carbon-zinc, alkaline, lead acid, nickel-cadmium (Ni—Cd), nickel-metal-hydride (NiMH) or lithium-ion (Li-Ion) battery type, of a suitable number of cells and cell capacity for providing a desired operating time and/or lifetime for a particular device, and may be intended for a single use or for being rechargeable or for both. Examples may include a one or two cell lead acid battery typically producing about 3 volts or about 6 volts, a three cell Ni—Cd battery typically producing about 3.6 volts, a four cell NiMH battery typically producing about 4.8 volts, a five cell NiMH battery producing about 6 volts, a Li-Ion battery typically producing about 3.5 volts, or a two-cell Li-Ion battery typically producing about 7 volts, it being noted that the voltages produced thereby will be higher when approaching full charge and will be lower in discharge, particularly when providing higher current and when reaching a low level of charge, e.g., becoming discharged.

While the present invention has been described in terms of the foregoing example embodiments, variations within the scope and spirit of the present invention as defined by the claims following will be apparent to those skilled in the art. For example, actuator 50 and associated internal switch 150 may be disposed on another part of light 10, 10' than a tail cap 30 thereof, e.g., on housing 22, 22'. Actuator 50 may be at a different angle and surface 34 may be substantially flat or may be curved, and either or both could be in a different location and/or orientation relative to light body 20, 20' and more than one actuator 50 may be provided.

Light source 90 may be a solid state light source 92 or an incandescent or other light source, and may produce white light, colored light, e.g., red or green light, infrared light or laser light. The optical elements and lenses therefor may be of different shapes, sizes and configurations than the examples illustrated.

Light 10, 10' may have more than one light source, and the light sources may produce white light, colored light, e.g., red or green light, infrared light and/or laser light. Light 10, 10' may also include a laser light source for providing a small spot or line of laser light for assisting aiming and/or identifying objects illuminated thereby.

Light 10, 10' may or may not have a clamping arrangement or other arrangement for mounting light 10, 10' to a firearm or to another object.

In addition, tail cap 30 may or may not have a rearward projection defining an undercut recess defining a surface 38, and may or may not include a connector for a remote switch or other accessory.

While certain features may be described as a raised feature, e.g., a ridge, boss, flange, projection, detent, or other raised feature, such feature may be positively formed or may be what remains after a recessed feature, e.g., a groove, slot, hole, indentation, recess, detent, or other recessed feature, is made. Similarly, while certain features may be described as a recessed feature, e.g., a groove, slot, hole, indentation, recess or other recessed feature, such feature may be positively formed or may be what remains after a raised feature, e.g., a ridge, boss, flange, projection or other raised feature, is made. In addition, where a raised feature engages a recessed feature, such as a cylindrical projection that engages a complementary receptacle, the relative positions of the raised and recessed features may be interchanged or other wise modified.

Each of the U.S. Provisional applications, U.S. Patent applications, and/or U.S. patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A switch and light comprising:

a light body having a forward end and a rearward end, said light body defining a longitudinal axis and having an internal cavity for receiving a source of electrical power;

a light source disposed at the forward end of said light body that produces light when energized;

an electrical switch internal to said light body disposed adjacent to an internal surface thereof that is substantially parallel to the longitudinal axis, wherein said electrical switch is actuatable by being moved in a direction substantially perpendicular to the longitudinal axis, wherein said electrical switch comprises:

a switch housing having an opening therethrough and having one or more coaxial pivot recesses;

a plunger supported by said switch housing, said plunger having first and second opposing sides and having one or more pivot axles respectively disposed in the one or more coaxial pivot recesses of said switch housing, whereby the movement of said plunger includes pivoting on the pivot axles in the opening of said switch housing for actuating and de-actuating said electrical switch; and a flexible boot disposed adjacent to the first side of said plunger wherein pressing said flexible boot causes said plunger to pivot relative to said switch housing and the second side of said plunger to move toward said electrical switch to actuate said electrical switch;

whereby said electrical switch is actuated when said flexible boot is pressed.

2. The switch and light of claim 1 further comprising: a circuit board disposed adjacent the opening of said switch housing and having an electrical switch element thereon, wherein said electrical switch element is actuatable by being pressed in a direction toward said circuit board.

3. The switch and light of claim 1 wherein said electrical switch includes:

a circuit board disposed adjacent to the internal surface and having a plurality of electrically conductive areas thereon, and a snap dome element adjacent to said circuit board, wherein said snap dome element is deformable for making an electrical connection between ones of the plurality of electrically conductive areas of said circuit board.

4. The switch and light of claim 3 wherein said plunger has a projection extending toward said snap dome element of said electrical switch.

5. The switch and light of claim 3 wherein said switch housing supports said circuit board and said snap dome element adjacent to the internal surface of said light body that is substantially parallel to the longitudinal axis.

6. The switch and light of claim 1 wherein: said flexible boot is adjacent to a first surface of said plunger that is at an acute angle relative to the internal surface of said light body, and/or said plunger has a projection extending toward said electrical switch.

7. The switch and light of claim 6 wherein: the acute angle between said flexible boot and the longitudinal axis is in a range between about 10° and about 60°.

8. The switch and light of claim 6 wherein: the acute angle between said flexible boot and the longitudinal axis is in a range between about 25° and about 45°.

9. The switch and light of claim 6 wherein: the acute angle between said flexible boot and the longitudinal axis is about 28°-29°.

10. The switch and light of claim 1 wherein said light body includes:

a clamping arrangement on a side thereof; or a clamping arrangement configured for grasping a firearm.

11. The switch and light of claim 1 wherein said light body includes a tail cap, and wherein: said tail cap includes said flexible boot, said plunger and said electrical switch.

12. The switch and light of claim 1 wherein said light body includes a clamping arrangement on a side thereof for grasping a firearm and has an electrical connector for receiving therein an electrical connector of a remote switch.

13. The switch and light of claim 1 wherein a surface of said plunger includes a friction reducing material.

14. The switch and light of claim 13 wherein the friction reducing material is selected from the group consisting essentially of: a petroleum-based grease, a petroleum-based lubricant, a graphite-based grease, a graphite-based lubricant, a silicone grease, and a silicone lubricant.

15. A switch for a light comprising:

a switch housing having an opening therethrough and having one or more coaxial pivot recesses;

a circuit board disposed adjacent the opening of said switch housing and having an electrical switch thereon, wherein said electrical switch is actuatable by being pressed in a direction toward said circuit board;

a plunger supported by said switch housing, said plunger having first and second opposing sides and having one or more pivot axles respectively disposed in the one or more coaxial pivot recesses of said switch housing, whereby the movement of said plunger includes pivoting on the pivot axles in the opening of said switch housing for actuating and de-actuating said electrical switch; and a flexible boot disposed adjacent to the first side of said plunger wherein pressing said flexible boot causes said plunger to pivot relative to said switch housing and the second side of said plunger to move toward said circuit board to actuate said electrical switch;

whereby said electrical switch is actuated when said flexible boot is pressed toward the circuit board.

16. The switch for a light of claim 15 wherein the first side of said plunger is at an acute angle relative to said circuit board and wherein the second side of said plunger has a projection extending toward said electrical switch.

17. The switch for a light of claim 15 wherein said electrical switch includes:

a snap dome element adjacent to said circuit board, wherein said snap dome element is deformable for making an electrical connection between ones of a plurality of electrically conductive areas of said circuit board.

18. The switch for a light of claim 17 wherein said plunger has a projection extending from the second side thereof toward said snap dome element of said electrical switch.

19. The switch for a light of claim 15 wherein the first side of said plunger which is adjacent to said flexible boot and the second side thereof define an acute angle that is less than the acute angle of said flexible boot relative to the circuit board.

20. The switch for a light of claim 19 wherein: the acute angle between said flexible boot and the circuit board is in a range between about 10° and about 60°.

21. The switch for a light of claim 19 wherein: the acute angle between said flexible boot and the circuit board is in a range between about 25° and about 45°.

22. The switch for a light of claim 19 wherein: the acute angle between said flexible boot and the circuit board is about 28°-29°.

23. The switch for a light of claim 15 further comprising:

a light body having a forward end and a rearward end, said light body having an internal cavity for receiving a source of electrical power; and a light source disposed at the forward end of said light body that produces light when energized;

wherein said circuit board is disposed internally to said light body adjacent to a surface that defines a reference plane, whereby said electrical switch is actuatable by being moved in the direction toward the reference plane.

24. The switch for a light of claim 23 wherein said light body includes a tail cap, and wherein: said tail cap includes said flexible boot, said plunger and said electrical switch.

25. The switch for a light of claim 23 wherein said light body includes:

a clamping arrangement on a side thereof; or a clamping arrangement configured for grasping a fire-arm.

26. The switch for a light of claim 23 wherein said light body further includes an electrical connector on a surface thereof for receiving therein a complementary electrical connector of a remote switch.

27. A switch and light comprising:

a light body having a forward end and a rearward end, said light body having an internal cavity for receiving a source of electrical power;

a light source disposed on said light body and that produces light when energized;

an electrical switch internal to said light body disposed adjacent to an internal surface thereof, wherein said electrical switch is actuatable by being moved in a direction transverse to the internal surface, wherein said electrical switch comprises:

a switch housing having an opening therethrough and having one or more coaxial pivot recesses;

a plunger pivotably supported by said switch housing, said plunger having first and second opposing sides and having one or more coaxial pivot axles respectively disposed in the one or more coaxial pivot recesses of said switch housing, whereby the movement of said plunger includes pivoting on the pivot axles in the opening of said switch housing for moving the second side thereof toward and away from the internal surface for actuating and de-actuating said electrical switch; and a flexible boot disposed adjacent to the first side of said plunger wherein pressing said flexible boot causes said plunger to pivot relative to said switch housing and the second side of said plunger to move toward said electrical switch to actuate said electrical switch;

whereby said electrical switch is actuated when said flexible boot is pressed.

* * * * *